United States Patent [19]

Avrea

[11] Patent Number: 4,498,599

[45] Date of Patent: Feb. 12, 1985

[54] CLOSURE AND VALVING APPARATUS

[76] Inventor: Walter C. Avrea, 1405 Whalers Way, Tempe, Ariz. 85283

[21] Appl. No.: 523,447

[22] Filed: Aug. 15, 1983

[51] Int. Cl.[3] ..... B65D 51/16

[52] U.S. Cl. ..... 220/203; 220/303; 220/DIG. 32

[58] Field of Search ..... 220/203, 208, 209, 316, 220/303, 304, DIG. 32, 293, 295, 298, 301

[56] References Cited

U.S. PATENT DOCUMENTS

| | | | |
|---|---|---|---|
| 3,164,288 | 1/1965 | Boomgaard | 220/203 |
| 3,910,451 | 10/1975 | Tusing | 220/203 |
| 4,000,828 | 1/1977 | Crute et al. | 220/203 |
| 4,185,751 | 1/1980 | Moore et al. | 220/203 |
| 4,196,822 | 4/1980 | Avrea | 220/203 |
| 4,241,845 | 12/1980 | Dahy et al. | 220/203 |

*Primary Examiner*—George T. Hall

*Attorney, Agent, or Firm*—Don J. Flickinger

[57] ABSTRACT

A sealing and valving assembly includes an upper carrier and a lower carrier sized to be received within the filler neck of the radiator of a pressurized liquid cooling system. The upper carrier, an inverted generally cup-like member, carries an atmospheric seal for closing the open end of the filler neck. The atmospheric seal may seal against the inner side wall or the free end of the filler neck. Both types of atmospheric seals may be incorporated in a single embodiment. A pressure seal, carried by the lower carrier, is normally urged against a seat proximate the fixed end of the filler neck by a cylindrical spring bearing against the upper and lower carriers. Preferably, the lower end of the spring is congruent with the pressure valve seat. The upper carrier is secured by swivel connection to a cap which is detachably securable to the free end of the filler neck. The upper carrier may also be detachably connected to the cap.

59 Claims, 28 Drawing Figures

CLOSURE AND VALVING APPARATUS

BACKGROUND OF THE INVENTION

1. Field of the Invention

This invention relates to liquid cooling systems of the type normally used in connection with internal combustion engines.

More particularly, the present invention relates to closure and valving devices for the filler neck of the radiator of a pressurized liquid cooling system.

In a further and more specific aspect, the instant invention concerns an improved closure and valving apparatus especially having means for preserving the integrity of the sealing engagement with the filler neck.

2. Prior Art

The primary function of an internal combustion engine is the conversion of the potential energy contained within fuel, usually gasoline or diesel oil, into a form which can be harnessed to perform useful work As a result of combustion of the fuel within the engine, the potential energy is released as heat. Approximately one-third of the heat energy is converted into power. Another third is discharged through the exhaust system. The final third is absorbed by the engine.

Within limits, the heat which serves to elevate the temperature of the engine is beneficial. It is a well established fact that what is commonly referred to as a "warm engine" operates nearer optimum efficiency than a cold engine. Continued heat absorption, above desirable limits, is extremely deleterious, ultimately resulting in the destruction of the engine.

To control temperatures within safe limits by removing excess heat, internal combustion engines are commonly provided with a liquid cooling system. In the conventional cooling system, heat is absorbed from the engine and transferred for dissipation to the atmosphere. Within the closed heat-transfer loop of the system, liquid functions as the heat transfer medium. Hence, the engine is referred to as being "liquid cooled".

Conventionally, the liquid cooling system for a typical internal combustion engine includes a water jacket, generally a plurality of inner connected passages or a single circuitous passage within the engine. The water jacket circumferentially embraces each of the one or several combustion chambers in which heat is generated as a result of the combustion of fuel.

Remote from the engine, usually in front thereof in an orthodox installation, is a radiator essentially including a core positioned between a pair of tanks. The core, being a heat exchanger, comprises a plurality of relatively small tubes surrounded by fins and air passages. At one end, the tubes communicate with an inlet tank. An outlet tank is located at the other end of the tubes. A conduit, colloquially referred to a radiator hose, extends between the outlet of the water jacket and the inlet tank. A similar conduit communicates between the outlet tank and the inlet of the water jacket.

A tubular member, referred to as a filler neck and extending from the inlet tank, provides means for introducing liquid into the system. The free end of the filler neck, in accordance with conventional manufacture, terminates with an outwardly directed annular ledge concluding with a depending circumferential skirt. An apparatus, commonly dubbed a radiator cap, is detachably securable to the circumferential skirt. Traditionally, an annular gasket carried by the cap seals against the annular ledge when the cap is fully engaged with the filler neck.

Within the system, heat is transferred by circulating liquid known as coolant. Excess heat generated by the engine is absorbed by the coolant within the water jacket. The circulating coolant carries the heat to the radiator, through the inlet tank and into the tubes of the core. In response to air passing through the core and the tubes, the heat is dissipated into the ambient atmosphere. The coolant, now being of lower temperature, flows through the outlet tank and is returned to the water jacket thereby displacing heated coolant.

Initially, radiators were gargantuan. The tubes extended vertically. The inlet tank resided atop the core, while the outlet tank was located underneath. In order to maintain a reserve supply of coolant and allow for expansion of the liquid, the inlet tank was of substantial capacity.

As a result of the functions performed, inlet tanks became known by various terms. Among these are "expansion tank", "water tank", "radiator tank", "top tank", "surge tank", and "reservoir". Although no longer appropriate in view of modern design, the archaic terminology persists. The designation "header tank", however, is apropos for either inlet or outlet tank.

Liquid cooling systems of early prior art design depended upon natural circulation, or thermosiphon, as a result of specific gravity differences of water within the system. Water, heated in the water jacket surrounding the combustion chambers, rises within the loop system to the inlet tank of the radiator. Cool water is drawn into the water jacket from the outlet tank of the radiator. Water is also displaced downwardly through the radiator for cooling. Depending upon constantly changing differences in specific gravity the cycle is continuous. The speed of circulation is proportional to the heat output of the engine.

Cooling systems relying upon thermosiphon have proven to be fairly adequate with engines of low-output, low-compression design. With the advent of more modern engines of greater horsepower and increased heat generation, thermosiphon was no longer effective. Lower hood profiles of motor vehicles also demanded more compact radiator design. Accordingly, forced circulation of air and coolant became a standard practice.

A pump was placed into the cooling system. Conventionally, the pump was secured to the engine at the inlet to the water jacket and received the hose extending from the outlet tank of the radiator. A fan was secured to the shaft of the pump immediately behind the radiator.

Other innovations of approximately the same era and made possible by the occurrence of forced circulation, further contributed to the historical development of the cooling system. Two notable improvements were pressurization of the system and the introduction of alternate cooling liquids. Cooling efficiency was increased, higher operating temperatures were possible, and corrosion was reduced.

To facilitate pressurization, there was introduced a radiator cap having a lid or cover member which extended over the free end of the filler neck. Generally a sheet metal stamping, the cover member included a pair of diametrically opposed tabs which engaged the downturned skirt at the free end of the filler neck. To prevent rotation of the cap, a spring friction diaphragm bore against the end of the filler neck. A compression spring, bearing at the upper end against the cover or the diaphragm, urged a gasket into seated engagement against a seat formed by an inwardly directed shoulder, usually including a raised annular bead, at the lower end of the filler neck. The several components were assembled by a rivet extending through the cover member. For purposes of relieving excess pressure within the system, the spring and gasket were known as the relief valve. Steam and hot water were expelled under the spring fiction diaphragm or through an overflow vent, usually in the form of a radially projecting nipple, residing intermediate the ends of the filler neck. Also included was a valve to relieve any vacuum created within the system as a result of cooling.

To augment the benefits of pressurization and further increase engine efficiency, an alternate coolant was introduced. The coolant was a mixture of antifreeze and water. In addition to providing cold weather protection, the mixture increased the allowable operating temperature before boiling. Further, the mixture reduced system corrosion.

It is now well known that in order to increase the operating temperature substantially above the boiling point of water, a highly desirable condition that will be readily recognized by those skilled in the art, a judicious selection of radiator cap design and coolant mixture is recommended. A common coolant mixture is one-half water and one-half antifreeze, such as ethylene glycol. This mixture increases the boiling point to 226 degrees F., 14 degrees F. above that of water.

The boiling point of a liquid under pressure is raised approximately 3 degrees F. for each one pound per square inch (1 psi) of pressure. Since the coolant system is pressurized, the boiling point is accordingly increased. A system operating under 15 psi with a mixture of equal parts water and antifreeze will, therefore, boil at approximately 271 degrees F.

It is apparent, therefore, that a cooling system utilizing a properly proportioned coolant mixture will operate with a maximum positive pressure as determined by the radiator cap. When the predetermined value of the spring is reached, the relief valve opens allowing discharge of the liquid coolant through the vent of the filler neck. Subsequently, as the temperature and pressure subside, as when the engine cools after being shut down, the relief valve closes and the vacuum valve opens to relieve the negative pressure or partial vacuum created by a contraction of the coolant.

Historically, as a result of repeated cycles of heating and cooling, substantial quantities of the liquid coolant containing the expensive antifreeze are lost, having been discharged through the vent to fall upon the ground. The mixture, precious to proper cooling, was supplanted by ambient air, a less efficient cooling medium. Accordingly, it was convention of the era for motorists to carry a supply of a make-up liquid, usually plain water.

During relatively recent times, the art sought to provide a remedy for the loss of coolant. Concurrently, the art addressed a problem previously ignored, but nevertheless known, from almost the beginnings of liquid cooling systems for internal combustion engines. Air, entrained within the liquid coolant, in addition to reducing efficiency, produced various deleterious effects including cavitation of the water pump, corrosion of the water jacket, and premature oxidiation of radiator hoses. It was also recognized that periodic removal of the radiator cap, necessitated by frequent need to check the coolant level, added additional air to the system. Further, removal of the cap presented potential personal safety hazards due to the presence of the hot or steamy coolant mixture.

The proposed remedy was in the form of method and apparatus for purging air from the cooling system. Included was an accumulator tank positioned within the engine compartment remote from the radiator. A conduit communicated between the normal vent or overflow of the filler neck and the lower part of the accumulator tank. An air vent was formed in the top of the accumulator tank.

The apparatus made use of the phenomenon that free air, if any, within the system will rise to the top of the inlet tank. Coolant, rising as a result of thermal expansion, will displace the air which will be forced out through the vent and the conduit into the accumulator tank. In reality, most air will be purged in a foamy or vaporous combination with coolant. Depending upon the heat build-up, a quantity of coolant will follow the air and the vaporous combination into the accumulator tank.

Once in the tank, the overflowed vapor or foam condenses. The air effervesces upwardly and escapes through the vent into the atmosphere. The deaerated coolant settles to the bottom of the accumulator tank. As the system cools, only deaerated coolant will be siphoned back through the vent valve.

The foregoing system, generally referred to as "overflow recovery", was favorably accepted and achieved substantial commercial success. The success was particularly pronounced within the motor vehicle art, especially passenger cars and light trucks. The functioning of the apparatus, however, as observed over a period of extended use, subverted the method. The primary contributor to the inferior result was the radiator cap.

Various types of caps have been used and currently are being used in connection with the system. A commonly employed cap is an adaption of conventional earlier design. Carried forward is the original stamped metal lid or cover member. An upright cylindrical element, also a metal stamping, having an upper end wall and an outwardly directed annular lip at the lower end, and frequently referred to as the "link" is axially secured to the underside of the cover member. A generally bell-shaped element, again a sheet metal stamping and generally called the "housing", is telescopingly engaged with the link. A pressure gasket and a vent valve are carried by the housing. A compression spring, encircling the link, biases the housing in a direction away from the cover member to urge the pressure seal into normal sealing engagement with the seat formed at the fixed end of the filler neck.

Variations of the primary configurations are known. For example, the basic design includes an atmospheric seal which sealingly engages the annular seat formed at the free end of the filler neck. In accordance with one scheme, the seal is carried by the cover member. An annular gasket is secured to the underside of the spring diaphragm in an alternate embodiment.

Differing means of attaching the link to the cover member are also practiced. In strict compliance with the prior art, the rivet remains as the attachment element. In a modified version, the upper end wall of the cylindrical link is bonded, such as by spot welding, to the underside of the lid.

An hermetic seal between the lid and the filler neck, at a location above the overflow vent of the filler neck, is mandatory for proper functioning of the system. It is now well known that to alleviate negative pressure or vacuum, the system will preferentially draw air through even the slightest of openings rather than siphon liquid from the accumulator tank. Accordingly, it is recommended that make-up coolant, if necessary, be added through the accumulator tank and that the radiator cap be removed only for occasional inspection. Owners, operators, and service station attendants not yet ready to rely upon the coolant level within the accumulator tank, frequently remove the radiator cap.

Radiator caps of the type having an atmospheric seal rotatable with the cover member are soon rendered worthless as a result of the seal being abraded against the filler neck. A similar phenomenon accelerates destruction of the pressure seal which is prohibited from rotation as a result of spring friction against the cover member and the housing. Inferior pressure spring configuration also contributes to deterioration of the pressure seal.

Experience has also shown that gasket-type atmospheric seals carried by the spring diaphragm are highly ineffective. Excessively pressurized coolant, having opened the pressure valve, is capable of unseating the gasket from the end of the filler neck and escaping to be lost from the system. The immediate type of seal also permits the hazardous, forceful emission of superheated steamy coolant when the cap is rotated to the vent or safe position.

Other inadequacies are inherent in radiator caps of riveted type construction. Initially, it is virtually impossible to set the rivet in the manner which will satisfactorily seal the opening through the cover member or the lid. Even if an acceptable mechanical bond is achieved during manufacture, the joint quickly loosens under the stress of use. In recognition thereof, certain manufacturers supply an auxiliary seal, usually in the form of an attachment to the exterior of the lid, over the rivet. Such auxiliary seals eventually deteriorate under conditions of actual use.

As a departure from the historical standard, the more modern art has devised radiator caps of non-metallic material, such as molded resinous plastic. One configuration is reminiscent of the more conventional metallic design. The former housing element is replaced by a disc-like membre, more appropriately called a pressure pad, having an upstanding projection. A cylindrical element, the approximate equivalent of the metallic link integrally depending from the cover member, telescopingly receives the projection extending from the pressure pad. The bore of the cylindrical element extends through the cover member and is closed by an external plug. The device utilizes a spring diaphragm fabricated of resinous material. At the lower end, the pressure spring encircling the cylindrical element bears against the pressure pad. The spring diaphragm is pressed against the cover member by the upper end of the pressure spring.

The newly developed apparatus adequately eliminated certain shortcomings of the more tradionally patterned devices. The resinous material is less susceptible to corrosion from contact with steam or antifreeze compounds. Being an inherently poor thermal conductor, the cover member does not represent a potential source of burns to the hand of an attendant. Also, the use of mechanical fastening means, such as rivets or spot welding, is eliminated.

New concerns, however, arose. In general, the components are more intricate. Injection molds, for creating the several resinous components, are expensive. In order to provide sufficient rigidity and withstand engine operating temperatures, the plastic is reinforced by glass filling. Glass, being a high friction material, lends an undesirable characteristic to certain of the components.

Other undesirable features remained. Exemplary, the opening through the cover member will still present the potential for system nullifying leakage. The previously described problems associated with the spring diaphragm are still in attendance.

A later developed radiator cap, also fabricated of resinous material, is endowed with various art enhancing features. The link, now an inverted cup-like component, carried by the cover member, supports the pressure pad and receives the pressure from the upper end of the spring. Thus, rotation retarding friction generated by the pressure spring is successfully eliminated. The device is fabricated of a relatively few, simple interlocking components. Dismissed was the previously present assembly opening through the cover member, the current design being monolithic.

Complementing the impervious cover member is a relocated atmospheric seal. Carried in a gland, or groove, formed into the cup-like link, or a cylindrical projection depending from the cover member, or partially in each, the atmospheric seal engages the inner cylindrical side wall of the filler neck. Accordingly, the seal remains intact in both the vent and the locked positions.

This structure, however, has not presented a perfect solution. Use of a molded cover member of resinous material is mandatory. The union between the link and the cover member is relatively intricate. Due to the extended engagement between the atmospheric seal and the filler neck, separation of the cover member from the link has been experienced.

It is apparent at this time, that no single specific configuration of a radiator cap has received universal acceptance. Those skilled in the art are dispersed, manufacturing and marketing a diverse array of radiator caps. A share of the diversity finds bases in functional objections. Other dispersion results from preference, partially subjectively contrived, of the various manufacturers.

For example, while it is generally conceded that the placement of the atmospheric seal within the filler neck is preferential, inherent design characteristics has precluded the concurrent use of a spring diaphragm or a gasket which will seat against the free end of the filler neck, considered by some to be desirable features. Also, manufacturers have been maneuvered into a position of selecting either a metallic radiator cap with the attendent features or a plastic unit with alternate attributes. In general, the art has heretofore been denied the advantageous qualities of each.

The cooling system has become highly critical as a result of further advances of automotive technology. Constantly lowering hood silhouettes, requiring decreased radiator size, and increased output per displacement ratios of engines, requiring greater cooling capacity, has imposed severe burdens upon the cooling systems. As a partial solution, the art has developed the "cross-flow" radiator in which the inlet and outlet tanks are disposed upright along either side of a core having horizontal tubes. Nevertheless, it remains that coolant system failure is the primary mechanical misfunction resulting in road break downs of motor vehicles. It is imperative, therefore, that each component of the cooling system of an internal combustion engine be maximally efficient.

It would be highly advantageous, therefore, to remedy the foregoing and other deficiencies inherent in the prior art.

Accordingly, it is an object of the present invention to provide an improved closure and valving apparatus especially adapted for use with the filler neck of the radiator of a pressurized liquid cooling system.

Another object of the invention is the provision of a closure and valving apparatus (radiator cap) having improved means for sealing engagement with a conventional filler neck.

And another object of the invention is to provide a radiator cap having new and novel means for preserving the integrity of the sealing engagement.

Still another object of the instant invention is the provision of a radiator cap having a sealing and valving assembly which is freely rotatably carried by a lid or attachment member.

Yet another object of the invention is to provide means whereby a predetermined sealing and valving assembly may be used with alternate attachment members of various design.

And still another object of the immediate invention is the provision of a radiator cap having accommodations for plural atmospheric seals.

A further object of this invention is to provide improved seal supporting means.

And a further object of the invention is the provision of a device capable of withstanding repeated engagement and disengagement with the filler neck.

Still a further object of this invention is to provide a closure and valving apparatus of simplified design.

And still a further object of the invention is the provision of closure and valving apparatus, according to the above, which is relatively inexpensive to manufacture.

Yet still a further object of the instant invention is to provide means for extending the life of the pressure seal.

SUMMARY OF THE INVENTION

Briefly, to achieve the desired objects of the instant invention, in accordance with a preferred embodiment thereof, first provided is an upper carrier, an inverted generally cup-like member having a cylindrical side wall and an upper end wall. An atmospheric seal, engagable with the inner side wall of a conventional filler neck, is carried by an annular groove formed into the side wall.

Next provided is a lower carrier, having a disc-like member functioning as a pressure pad and carrying a pressure seal. A pressure spring, having upper and lower ends which bear against the respective carriers, normally biases the pressure seal into sealing engagement with the seat formed at the fixed end of the filler neck. The spring is configured to exert force upon the pressure seal in substantial opposed alignment with the bead of the pressure seal. A vent valve is also carried by the lower carrier.

The upper and the lower carrier, along with the pressure spring and other attendant elements, describe a sealing and valving assembly. Swivel means are provided for connecting the assembly to an attachment member having engagement means detachably securable to the normal engagement receiving means of the filler neck. Stabilizing means maintain the attachment member in axial alignment with the sealing and valving assembly.

In accordance with a further embodiment of the invention, the upper carrier is provided with an outwardly directed annular flange. A second atmospheric seal, sealingly engagable with the free end of the filler neck, is carried by the flange.

BRIEF DESCRIPTION OF THE DRAWINGS

The foregoing and further and more specific objects and advantages of the instant invention will become readily apparent to those skilled in the art from the following detailed description of preferred embodiments thereof taken in conjunction with the drawings, in which.

DETAILED DESCRIPTION OF THE PREFERRED EMBODIMENTS

Figure 1:
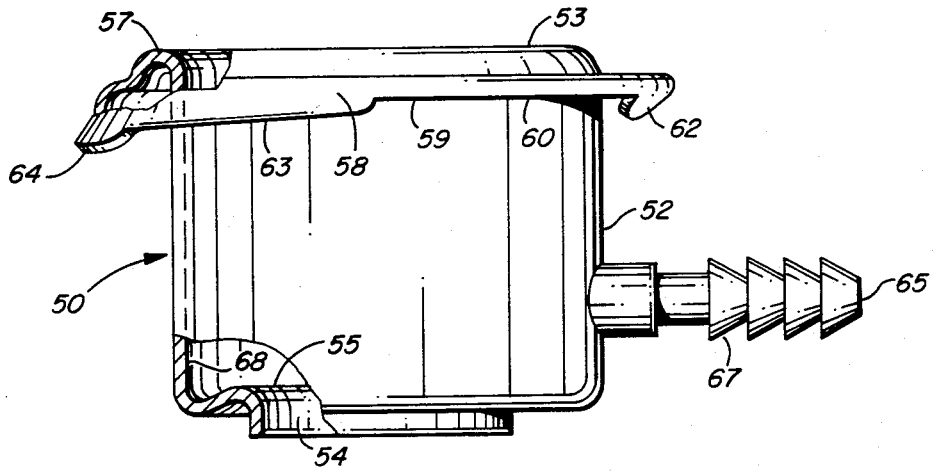
FIG. 1 is an elevation view of a typical filler neck of the type normally associated with the radiator of a liquid cooling system as concerns the instant invention, the illustration being presented for purposes of reference and orientation in connection with the instant disclosure and having portions thereof broken away for further clarity.

Turning now to the drawings in which like reference characters indicate corresponding elements, attention is first directed to FIG. 1 which illustrates the exemplary filler neck, generally designated by the reference character 50, having tubular body 52 with open upper and lower ends 53 and 54, respectively. Proximate lower end 54, tubular body 52 is formed generally inwardly and downwardly to provide a pressure valve seat 55, more specifically in the form of a convex annular shoulder to create a well defined sealing surface of limited cross-sectional area.

The upper end 53 of tubular body 52 is shaped outwardly and downwardly to form annular ledge 57 and circumferential skirt 58. Ledge 57, being circumferential about open end 53 and generally convex in cross-section, may function as a gasket seat Although not seen in the immediate view, but as will be appreciated by those skilled in the art, circumferential skirt 58 is severed by two diametrically opposed cut-outs. Formed between the cut-outs are diametrically opposed connection receiving means 59 (only one herein expressly illustrated). The cut-outs accommodate the connection means of the radiator closure apparatus, as will be hereinafter described in detail.

Each connection receiving means 59 includes a first downwardly directed edge 60 which is substantially parallel to the surface of ledge 57. Edge 60 defines the unlocked closure apparatus position which is variously defined as the safe or vent position. Detent 62, residing between edge 60 and the cut-out, requires a deliberate action by the attendant to rotate the cap from the safe position to the removal position. Adjacent first edge 60 is camming edge 63 which is gradually directed downwardly therefrom throughout its length, terminating with stop 64 at the other end thereof. Edge 63 cams the closure apparatus into the lock position, which is alternately referred to as the working or operating position.

An overflow passage 65 extends, by means of radially projecting nipple 67, from a point above pressure valve seat 55 and below annular ledge 57. Passage 65 functions as a vent whereby overflow, including steam and superheated liquid coolant, is discharged from the radiator to the atmosphere. In standard practice, a flexible tube or hose is attached to nipple 67 to direct overflow away from the hands and face of one attending to open the radiator. In a coolant recovery system of prior art design, the flexible tube or hose communicates with an accumulator tank.

By way of example in accordance with conventional manufacturing technique, filler neck 50 is integrity shaped from 0.30 inch brass stock such that cylindrical inner surface 68 is continuous with the gasket surfaces 55 and 57. Although not herein illustrated, the filler neck 50 is generally soldered or brazed in airtight securement to the upper surface of the inlet header tank of the radiator with the lower open end 54 in communication with the interior of the radiator.

In the foregoing description, the illustrated configuration is taken from a typical radiator filler neck for the purposes of adding reality to the neck and for purposes of orientation with the ensuing detailed description of the embodiments of the invention. The description is for purposes of reference only, it being understood that not all filler necks are so exactly sized and shaped, nor that the embodiments of the radiator closure and valving apparatus described hereinafter is limited to the exact size and shape for the specifically illustrated neck.

Figure 2:
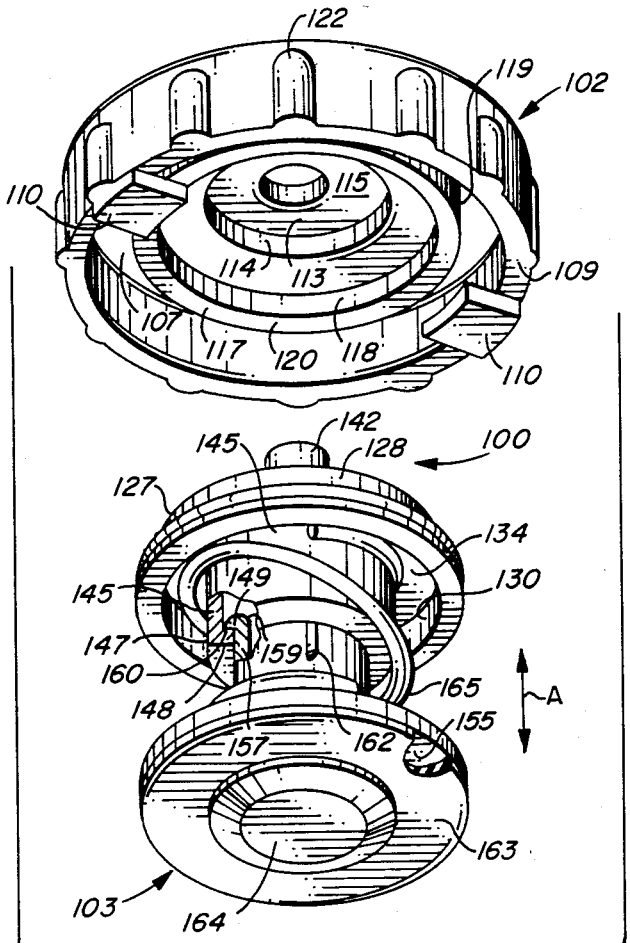
FIG. 2 is a partially exploded perspective worms-eye view of an improved closure and valving apparatus of the instant invention, portions thereof being broken away for purposes of illustration.
Figure 3:
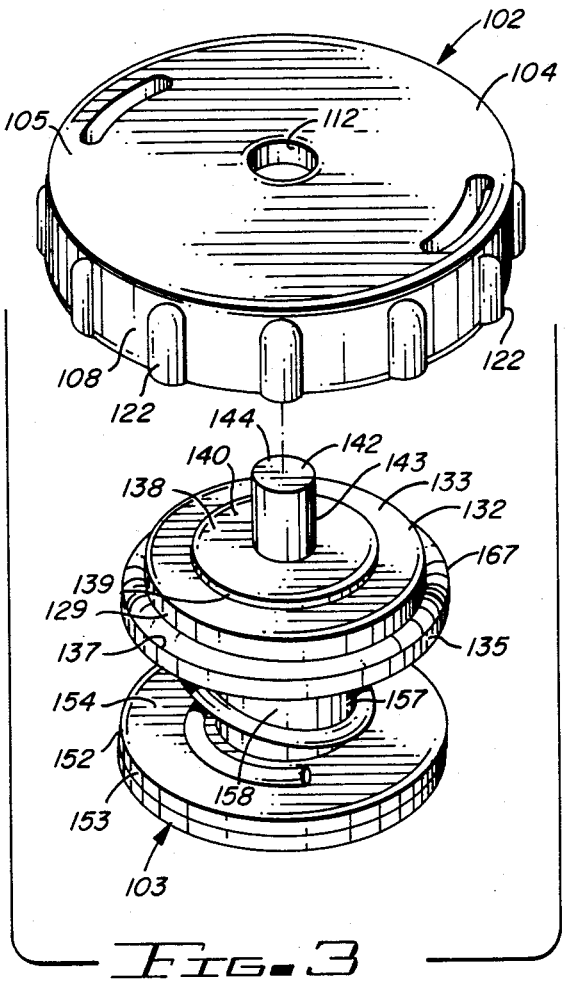
FIG. 3 is a view generally corresponding to the illustration of FIG. 2, except being birds-eye perspective.

Illustrated in FIGS. 2 and 3 is a radiator closure and valving apparatus of the instant invention, generally designated by the reference character 100, including an attachment member and a sealing and valving assembly, generally designated by the reference characters 102 and 103, respectively. Closure and valving apparatus 100 is especially configured to function in combination with the exemplary filler neck 50.

Attachment member 102 includes cover 104 having substantially planar top and bottom surfaces 105 and 107, respectively. Cylindrical periperal skirt 108, terminating with lower edge 109, depends from cover 104. A pair of diametrically opposed tabs 110 project inwardly from skirt 108.

Cylindrical aperture 112 projects through cover 104 at the approximate axis of rotation thereof. Counterbore 113, defined by cylindrical side wall 114 and end surface 115, is formed into cover 104 from undersurface 107. Cylindrical projection 117, having inner cylindrical surface 118, outer cylindrical surface 119 and annular free edge 120, depends from undersurface 107 of cover 104.

In accordance with conventional practice, as will be readily recognized by those skilled in the art, cover 104 is sized to span the open upper end 53 of filler neck 50.

Skirt 108, of attachment member 102, is sized to receive skirt 58 of filler neck 50. Tabs 110, functioning as engagement means, are receivable through the cut-outs in skirt 58 and are engagable with edges 60 and 63 of the connection receiving means 59 for detachable securement of closure and valving apparatus 100 to filler neck 50 in the common manner. A plurality of bumps 122, periodically spaced about skirt 108, enhance the manual grip of the operator or attendant while rotating the device relative filler neck 50.

Sealing and valving assembly 103 includes upper carrier 127 which supports the other elements of the assembly and interacts with attachment member 102. Carrier 127, being generally in the form of an inverted cup, includes upright cylindrical section 128 having outer surface 129 and inner surface 130 and upper end wall 132 having topsurface 133 and undersurface 134. Cylindrical section 128 terminates, at the free end, with outwardly directed annular flange 135 having shoulder surface 137.

Boss 138, having outer cylindrical surface 139 and top surface 140, projects upwardly from topsurface 133 of end wall 132 coaxial with outer surface 129 of cylindrical section 128. Post 142, having outer cylindrical surface 143 and free end 144, projects upwardly from topsurface 140 of boss 138. Tubular projection 145, having outer side wall 147 and free end 148, depends from undersurface 134 of upper end wall 132. Inwardly directed annular shoulder 149 resides proximate free end 148.

Generally disc-shaped pressure pad 152 includes outer surface 153, topsurface 154 and undersurface 155. Tubular projection 157, having outer surface 158 coaxial with outer surface 153, projects upwardly from topsurface 154 to terminate with free end 159. The pressure pad and the tubular projection comprise a lower carrier. Outwardly directed annular shoulder 160 resides proximate free end 159. At least one longitudinally elongated opening 162 extends through tubular projection 157. A pressure sealing gasket 163, as will be described in further detail presently but well known by those skilled in the art, is carried against the undersurface 155 of pressure pad 152. Similarly, a vent valve 164, of familiar prior art design, is also carried by pressure pad 152.

Tubular projection 157, projecting upwardly from pressure pad 152, is telescopingly received within tubular projection 145 depending from carrier 127. The interference between shoulders 149 and 160 prevent separation of the elements. To faciliate assembly, by snap engagement, the inner portion of the free end 148 of tubular projection 144 may be rounded or beveled. A similar treatment may be applied to the outer edge of the free end 159 of tubular projection 157. Pressure spring 165, being of the compression type, bears at one end against surface 134 and at the other end against surface 154 to urge carrier 127 and pressure pad 152 in opposite directions as indicated by the double arrowed line A. The upper end of spring 165 is closely received about outer side wall 147 of tubular projection 145 or axial alignment.

When assembled, post 142 projects through opening 112 above surface 105 of cover 104. Being preferably fabricated of a plastic material, the free end 144 of post 142 is upset, as by heat, to form a head or enlargement larger than opening 112 to affect the union, retention means, between attachment member 102 and sealing and valving assembly 103. Post 142 is of sufficient height such that after assembly the distance between the upset head or enlargement and surface 140 is greater than the thickness of cover 104 to allow for axial movement of attachment member 102 relative sealing and valving assembly 103. Similarly, sufficient clearance exists between post 142, functioning as a pintle, and opening 112 to allow for radial movement of attachment member 102 relative sealing and valving assembly 103. Accordingly, it is seen that post 142 and opening 112 function as swivel means for uninhibited movement of sealing and valving assembly 103 relative attachment member 102.

During assembly, atmospheric seal 167, herein specifically illustrated as a conventional O-ring encircling outer surface 129 of carrier 127, is captivated between the free edge 120 of cylindrical projection 117 and shoulder surface 137 of annular flange 135. It is not necessary that seal 167 be in concurrent contact with surfaces 120 and 137. To further enhance the swivel connection between attachment member 102 and sealing and valving assembly 103, inner cylindrical surface 118 of cylindrical projection 117 loosely embraces outer surface 129 of carrier 127. Topsurface 133 of upper end wall 132, being a lesser annular portion of the top of carrier 127, functions as a thrust bearing against undersurface 107 of attachment member 102. Axial alignment is achieved by the rotational fit of cylindrical surface 139 of boss 138 within cylindrical side wall 114, counterbore 113. Boss 138 has a height substantially less than the depth of counterbore 133. Accordingly, substantial clearance exists between surfaces 115 and 140.

When the foregoing described embodiment of the invention is secured to a conventional filler neck, such as represented by filler neck 50, pressure pad 152 and vent valve 164 operate in accordance with well known prior art function. Pressure sealing gasket 163, backed by pressure pad 152 and urged downwardly by spring 165 against valve seat 55, provides a pressure seal to retain coolant within the radiator below a predetermined pressure in accordance with the selected rate of spring 165. When the pressure of the coolant exceeds the predetermined valve, pressure pad 152 is urged upwardly, compressing spring 165 and lifting gasket 163 from seat 155 for discharge of fluid through overflow passage 65. After cooling, vent valve 164 opens in response to negative pressure within the radiator to draw make-up fluid, either ambient air or coolant from an accumulator tank, through overflow vent 65. Carrier 127 and pressure pad 152 reside above and below, respectively, passage 65 for unobstructed flow of fluid. Atmospheric seal 167, sealingly engaged with cylindrical inner surface 68 of tubular body 52, prevents the ingress or egress of fluid through open upper end 53 of filler neck 50.

Rotational movement of sealing and valving assembly 103, within filler neck 50, is inhibited as a result of the frictional contact between seal 167 and surface 68 and between gasket 163 and valve seat 55. The extremes of connection, between the removal position and the fully locked position, demand that attachment member 102 be rotated nearly a full half turn. As a result of the swivel connection between attachment member 102 and sealing and valving assembly 103, attachment member 102 is separately rotatable causing only a slight axial movement of sealing and valving assembly 103.

In order to prevent the escape of liquid around post 142 through opening 112, it is imperative that carrier 127 be fabricated of an impervious material. A molded resinous material, which may be glass reinforced, is recommended. For continuity of manufacturing methodology, attachment member 102 and the lower carrier may be similarly constructed.

Figure 4:
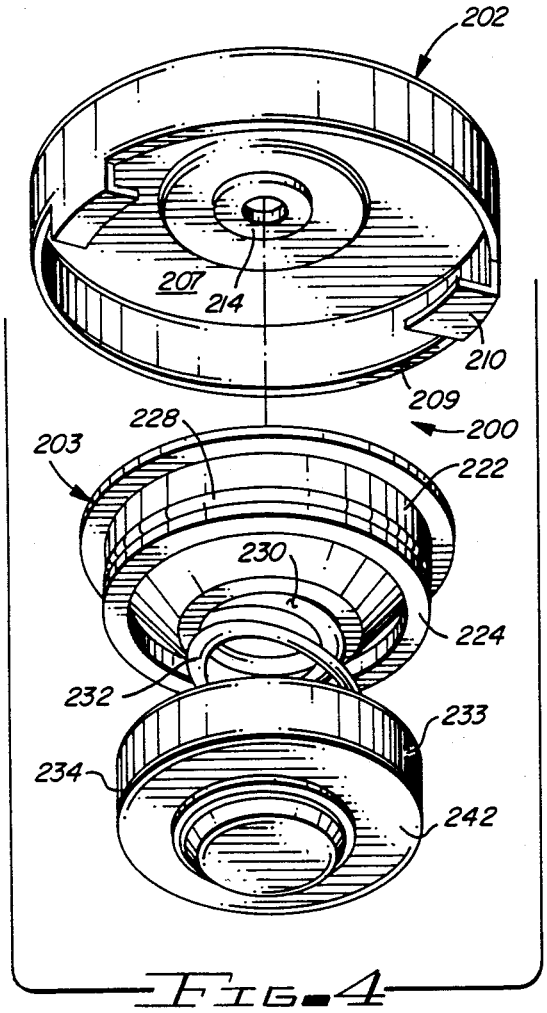
FIG. 4 is a partially exploded worms-eye perspective view of an alternate valving and closure apparatus embodying the principles of the instant invention.
Figure 5:
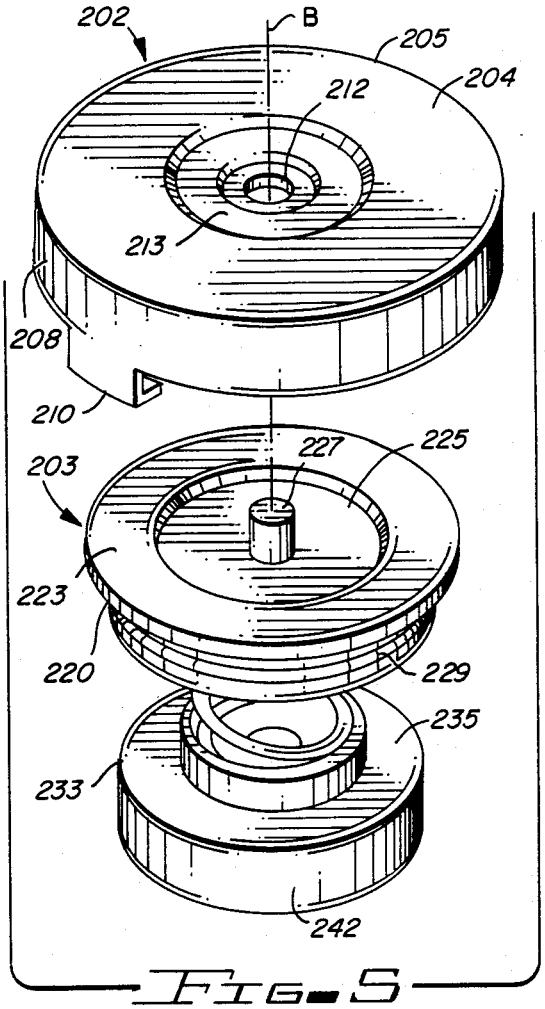
FIG. 5 is a birds-eye perspective view of the embodiment of FIG. 4.

With reference to FIGS. 4 and 5, there is seen another embodiment of the invention generally designated by the reference character 200. In general similarity to the previously described embodiment, the immediate embodiment includes an attachment member and a sealing and valving assembly, generally designated by the reference characters 202 and 203, respectively.

Attachment member 202, which may be readily fabricated as a sheet metal stamping, includes cover 204, having topsurface 205 and undersurface 207, and depending cylindrical peripheral skirt 208 terminating with lower edge 209. Diametrically opposed tabs 210 project inwardly from proximate lower edge 209 of skirt 208. Opening 212, being substantially axially aligned, through cover 204. A recess 213 is formed downwardly into cover 204. Annular undersurface 214, a relatively small surface immediately adjacent 212, is formed as a result of the creation of recess 213. Attachment member 202 is detachably securable to filler neck 50 as previously described in connection with attachment member 102.

Sealing and valving assembly 203 includes upper carrier 220, which analogous to carrier 127 is fabricated of a liquid impervious material, having upright cylindrical surface 222, top surface 223 and undersurface 224. Circular recess 225 is formed in the center portion of topsurface 223. Post 227 extends upwardly from recess 225. Cylindrical surface 222, recess 225 and post 227 are coaxial along the central axis of rotation designated by the reference character B. Circumferential groove 228 formed in cylindrical surface 222 carries the atmospheric or main seal, herein illustrated as conventional O-ring 229.

Blind bore 230 is coaxially formed into carrier 227 from undersurface 204. The upper end of pressure spring 232 is restrictively held in blind bore 230. Pressure pad 233 includes undersurface 234 and topsurface 235 having upstanding cylindrical projection 237 which constrictively embraces the lower end of spring 232. Pressure pad 233 and cylindrical projection 237 form a lower carrier for supporting further elements of the sealing and valving assembly.

Bore 238 extends coaxially through pressure pad 233. Tubular projection 239 coaxially disposed with respect to bore 238 and having outwardly extending circumferential ridge 240, depends from lower surface 234. Pressure sealing gasket 242 is carried against undersurface 234 of pressure pad 233 by virture of the engagement of central opening 243 about projection 239 under ridge 240.

Vent valve 244 of the conventional prior art gravity type is carried by pressure pad 233. Stem 255 is slidably disposed within bore 238. Disc-like valve member 257, closeable against gasket 242 in response to pressure within the radiator, is carried at the lower end of stem 255. The assembly is retained within pressure pad 233 by retainer 248 carried at the upper end of stem 255.

Figure 8:
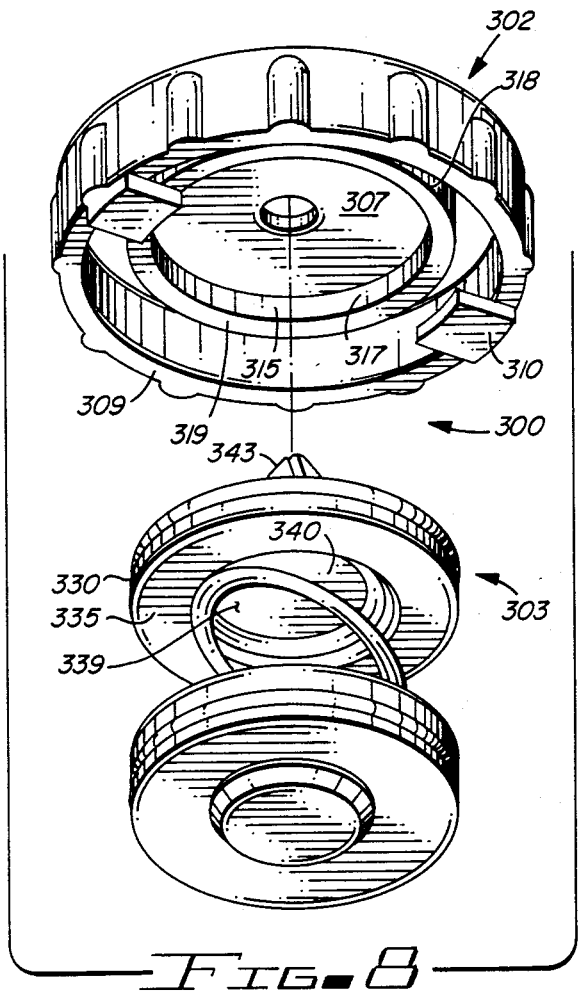
FIG. 8 is a partially exploded worms-eye view of another embodiment of the instant invention.

Attachment member 202 and sealing and valving assembly 203 are assembled in swivel fashion to ensure uninhibited relative rotation. Post 227 is loosely received through opening 212. The free end of post 227 is upset to form head or enlargement 249 as also seen in FIG. 8. Recess 225 in topsurface 223 of carrier 220 is shallower than recess 213 formed in cover 204 of attachment member 202. Accordingly, the contact between cover 204 and carrier 220 is restricted to the area of surface 214 which functions as stabilizing and thrust bearing means between attachment member 202 and sealing and valving assembly 203.

Functioning of the immediate embodiment is in accordance with the function previously set forth in connection with the embodiment designated by the reference character 100. Comparative thereto, friction between seal 229 and gasket 242 with inner surface 68 and valve seat 55, respectively, of filler neck 50, rotation of sealing and valving assembly 203 is retarded. Attachment member 202, however, is freely rotatable among the several engagement positions. During rotation of engagement 202, sealing and valving assembly 203 is limited to minor axial movement as indicated by the double arrowed line designated by the reference character A.

Figure 9:
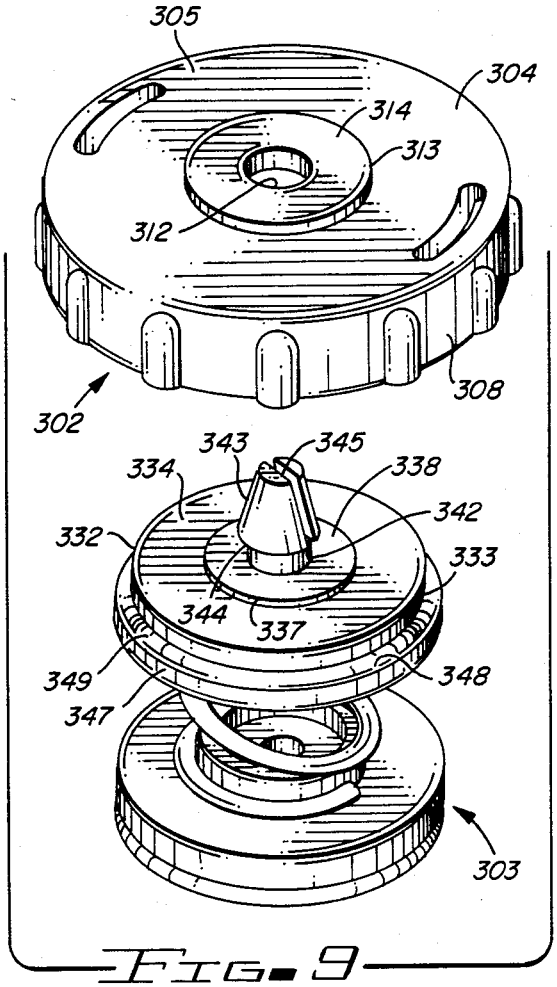
FIG. 9 is a birds-eye view of the illustration of FIG. 8.
Figure 10:
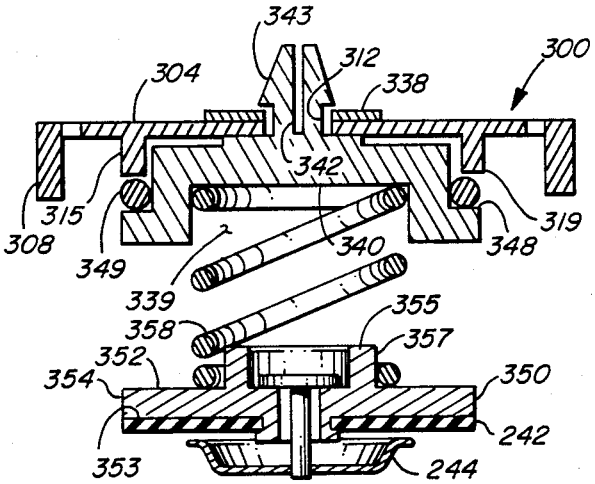
FIG. 10 is an illustration of the embodiment of FIGS. 8 and 9 as it would appear when assembled and in section along the longitudinal axis thereof.

Another embodiment of the invention, generally designated by the reference character 300 and including attachment member 302 and sealing and valving assembly 303, is seen in FIGS. 8, 9 and 10.

Attachment member 302 includes cover 304, sized to span across open upper end 53 of filler neck 50, having topsurface 305 and undersurface 307. Skirt 308, terminating with lower edge 309 with inwardly directed tabs 210 and sized to encircle skirt 58 of filler neck 50, depends from cover 304. Axially aligned opening 312 extends through cover 304. Cylindrical boss 313, having annular topsurface 314, projects upwardly from surface 305 coaxial with opening 312. Cylindrical projection 315, having inner cylindrical surface 317, outer cylindrical surface 318 and annular free edge 319, projects from under surface 307 coaxial with opening 312.

Sealing and valving assembly 303 includes carrier 330 having upright cylindrical section 332 with outer side wall 333, topsurface 334, and undersurface 335. Cylindrical boss 337, having topsurface 338 is axially carried on surface 334. Blind bore 339, having end wall 340, is formed into carrier 330 from undersurface 305.

Axially aligned post 342 projects upwardly from topsurface 338 of boss 337. Frustoconical head 343 terminates the free end of post 342. Head 343, which is upwardly directed, terminates at the lower end with annular shoulder 344 projecting inwardly to post 343 and spaced above surface 338. Head 343 is bifurcated by means of diametrical slit 345.

Circumferential flange 347 projects from outer side wall 333 proximate the lower portion of cylindrical section 332. Annular shoulder 348, the upper surface of flange 347 supports annular atmospheric seal 349 which encircles outer side wall 333.

Figure 7:
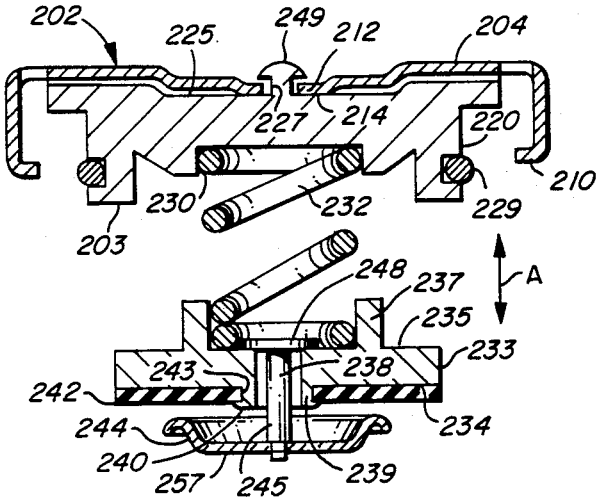
FIG. 7 is a vertical sectional view taken along the lines 7—7 of FIG. 6.
Figure 6:
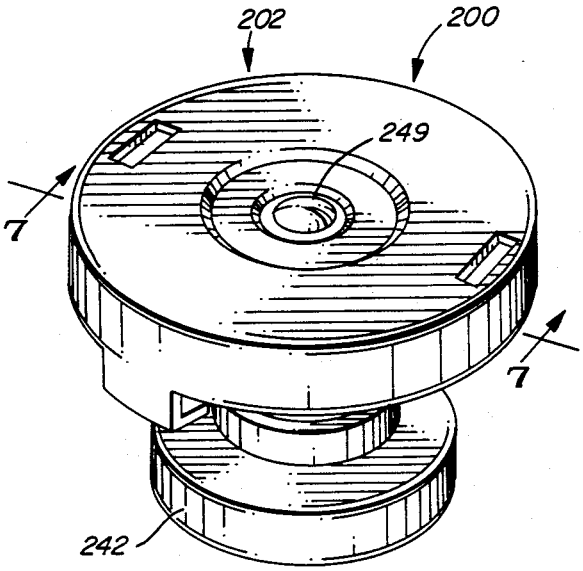
FIG. 6 is a perspective view of the embodiment of FIGS. 4 and 5 as it would appear when assembled.

Pressure pad 350, including topsurface 352, undersurface 353 and outer cylindrical side wall 354 is sized to be received within filler neck 50. Cylindrical projection 355, having outer surface 357, projects upwardly from surface 352. Pressure sealing gasket 242 and vent valve 244 are carried by pressure pad 350 as previously illustrated and described in connection with FIG. 7.

Pressure spring 358, specifically a coiled compression spring, extends between carrier 330 and pressure pad 350. The upper end of spring 358 is engagably nestled within blind bore 339 to bear against end wall 340. The lower end of spring 358 encircles cylindrical projection 355, being constrictively engaged about outer surface 357 and bearing against topsurface 352.

As will be appreciated by those skilled in the art, the several components of the instant embodiment are assembled or disassembled by a snap engagement for convenient replacement of a damaged component. The respective ends of spring 358 are snapped into bore 339 and over projection 355. Post 342 is inserted upwardly through opening 312 during which time the bifurcated portions of head 343 are compressed, closing or nearly closing slit 345. Due to the natural resiliency and memory of the material, preferably a plastic, head 343 returns to the free position with shoulder 344 above surface 338 for retention of carrier 330 with cover 304.

As particularly noted in FIG. 10, a swivel union exists between attachment member 302 and sealing and valving assembly 303. Free rotation is assured by ample radial clearance between post 342 and opening 312. Similarly, the distance between shoulder 344 and surface 338 exceeds the distance between surfaces 338 and 307. Surface 338 functions as stablizing means and as a thrust bearing during engagement of the closure and valving member with filler neck 50. As noted in connection with the previous embodiments, attachment member 302 rotates relative filler neck 50 while sealing and valving assembly 303 is confined to relatively minor longitudinal movement.

Figure 11:
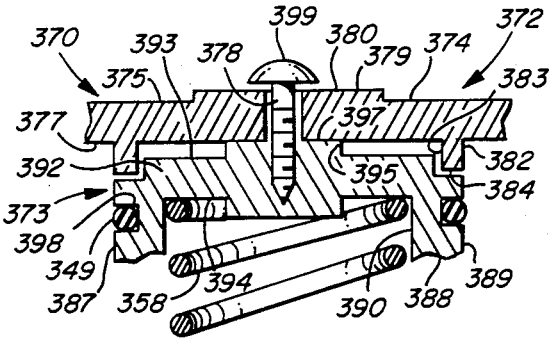
FIG. 11 is a fragmentary vertical sectional view, generally corresponding to the upper portion of the illustration of Fig. 10, and illustrating a modification thereof.

Illustrated in FIG. 11 is an alternate embodiment of the instant invention generally designated by the reference character 370 and representing a modification of the previously described embodiment designated by the reference character 300. As in the previous embodiments, the immediate embodiment includes attachment member 372 and sealing and valving assembly 373.

Attachment member 372 includes cover 374 having topsurface 375, undersurface 377 and centrally located opening 378. Cylindrical boss 379, having topsurface 380, projects from surface 375 coaxial with opening 378. Cylindrical projection 382, having inner surface 383 and free edge 384, depends from surface 377 coaxial with opening 378.

Sealing and valving assembly 373 is represented by carrier 387 having upright cylindrical portion 388 having outer surface 389 and inner surface 390 and upper end wall 392 having top surface 393 and undersurface 394. Axially aligned boss 395 having topsurface 397, projects upwardly from surface 393. Annular groove 398 formed in outer surface 389 of upright cylindrical section 388, carries atmospheric seal 349. The upper end of spring 358 is contained within inner surface 390 of cylindrical portion 388 bearing upwardly against surface 394. Pressure pad 350, as previously described, is engaged with the lower end of spring 358.

Attachment member 372 and sealing and valving assembly 373 are assembled by any convenient fastening element such as drive screw 399. Drive screw 399, which is freely received through opening 378 and mechanically and frictionally engaged within end wall 392, functions as a swivel connection means in the manner of post 342. Surface 397 functions as a thrust bearing between attachment member 372 and sealing and valving assembly 373.

Figure 12:
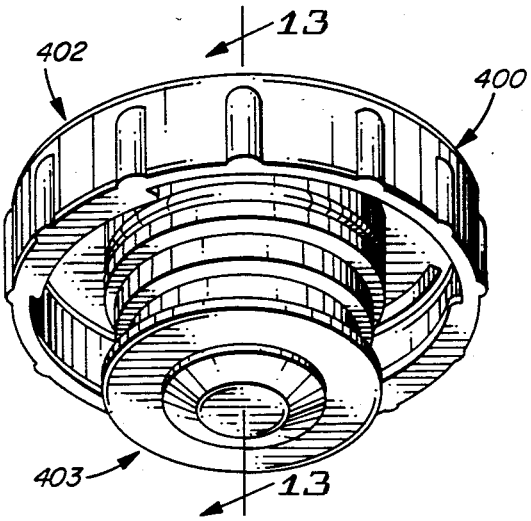
FIG. 12 is a worms-eye perspective view of yet another closure and valving apparatus of the instant invention.

Yet another embodiment of the instant invention, generally designated by the reference character 400, is seen in FIG. 12. Analogous to previously described embodiments, the immediate embodiment includes attachment 402 and sealing and valving assembly 403.

Figure 14:
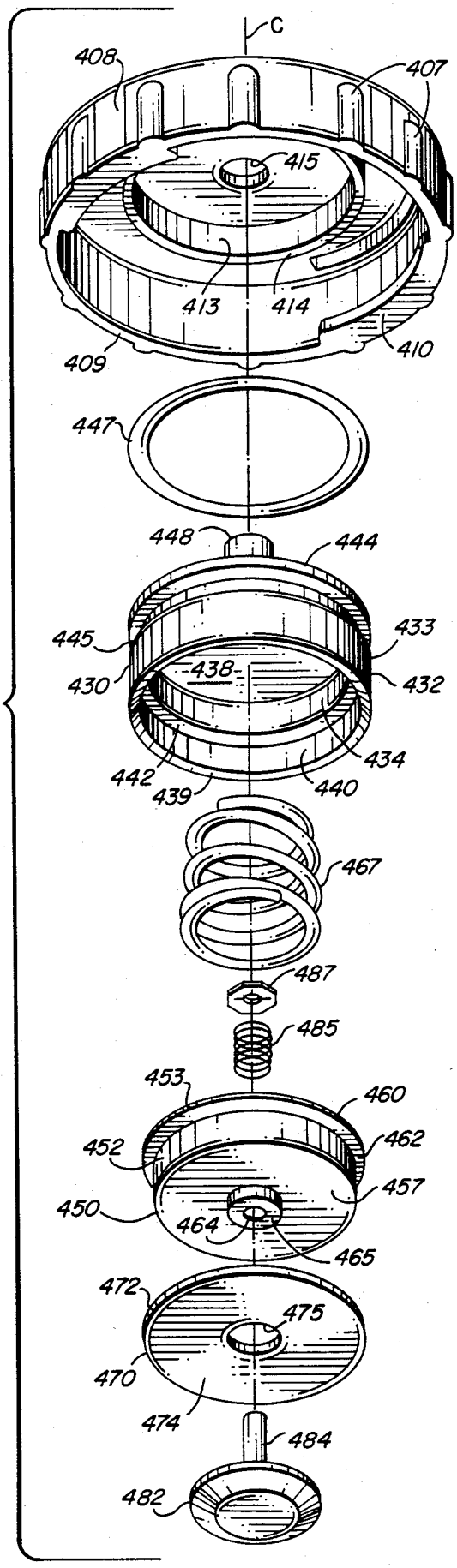
FIG. 14 is an exploded perspective view of the embodiment of FIG. 12.
Figure 13:
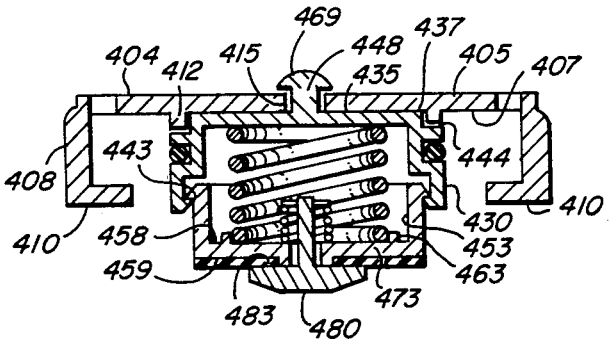
FIG. 13 is a vertical sectional view taken along the lines 13—13 of FIG. 12.
Figure 15:
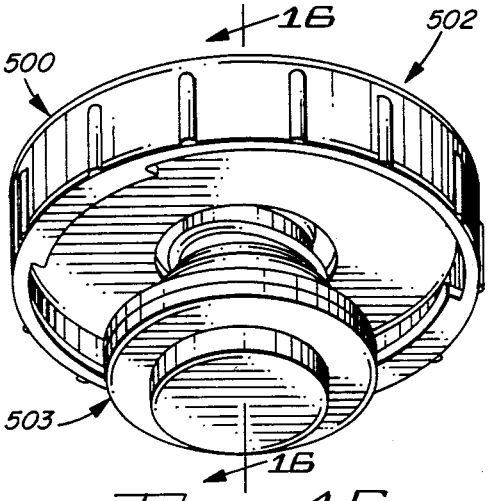
FIG. 15 is a worms-eye perspective view of still another embodiment of the instant invention.

With further reference to FIGS. 13 and 14, it is seen that attachment member 402 includes cover 404, sized to span the open upper end 53 of filler neck 50, having topsurface 405 and under surface 407. Peripheral skirt 408 depends from cover 404 and concludes with downwardly directed free edge 409. Engagement means, for purposes previously described, in the form of inwardly directed tabs 410, project from the lower edge 409 of skirt 408.

Cylindrical projection 412, having inner surface 413 and terminating with downwardly directed free edge 414, depends from undersurface 407. Opening 415 extends through cover 404. Each of the foregoing components are coaxial about the longitudinal axis of rotation graphically represented by the broken line C. Raised elements 407, periodically spaced about skirt 408, lend a knurled effect and facilitate manual gripping of the attachment member during rotation.

Sealing and valving assembly 403 includes upper carrier 430, being a generally inverted cup-shaped member of fluid impervious material, includes upright cylindrical section 432 having outer and inner side walls 433 and 444, respectively, and end wall 435 having topsurface and undersurface 437 and 438, respectively. Upright cylindrical section 432 is counterbored from the lower free edge 439 to form enlarged inner side wall 440 and annular shoulder 442. Inwardly directed annular shoulder or lip 443 resides proximate the lower end of enlarged inner side wall 440. Lower edge 439 is inwardly, upwardly, frustoconically beveled to substantially meet annular lip 443. Annular recess 444 is formed at the juncture of surfaces 433 and 437. Annular groove 445, formed in surface 433, accommodates atmospheric seal 447. Post 448 projects upwardly from top surface 437 of end wall 435. As will be appreciated by those skilled in the art, the several elements are concentric with the longitudinal axis of rotation designated by the broken line C.

Pressure pad 450, being generally cup-shaped and defining a lower carrier, includes upright cylindrical section 452 having outer side wall 453, inner side wall 454 and upper free edge 455 and lower end wall 457 with topsurface 458 and undersurface 459. Circumferential ridge 460 creating downwardly directed annular shoulder or lip 462, resides proximate end 453. Preferably, end 453 is beveled in a downwardly, outwardly, frustoconical shape. Annular projection 463 extends upwardly from surface 458. Centrally located opening 454 extends through lower end wall 457 and circular boss 465 projecting from surface 459. In similarity to the elements of carrier 430, each of the elements of pressure pad 450 are coaxial about the axis of rotation represented by the broken line C. Pressure spring 467 extends between carrier 430 and pressure pad 450 as will be further described presently. Pressure seal 470, a generally disc-like member, includes cylindrical peripheral surface 472, substantially parallel planar top and bottom surfaces 473 and 474, respectively, and centrally located opening 475. Vent valve 480 includes disc-like valve member 482 having upper valving surface 483 from which projects stem 484. Also included are vent spring 485 and a retainer in the form of snap clip 487.

The several elements of the sealing and valving assembly 403, as viewed in FIG. 14, are united as seen in FIG. 13 by snap engagement. Opening 475, through pressure seal 470 closely, preferably frictionally, receives boss 465 of pressure pad 450 such that surfaces 473 and 459 reside in contact. Stem 484 of vent valve 480 projects upwardly and is loosely received through opening 464 in pressure pad 450. Spring 485 is coaxially received about stem 484 to which is engaged retainer 487. Being slightly compressed and bearing against retainer 487 and surface 458, spring 485 urges disc-like valve member 482 upwardly normally holding surface 483 into sealing engagement with seal 470. The rate of spring 485 is calculated to yield to downward force of disc-like valve member 480 as a result of negative pressure within the radiator.

The lower end of spring 467 is seated against topsurface 458 of pressure pad 450 within annular projection 463. Pressure pad 450 and carrier 430 are pressed together. As a result, the camming action of beveled edges 439 and 453, ridge 460 passes within lip 443 to place ridge 460 in telescoping residence within enlarged inner side wall 440. Spring 467, residing against surfaces 438 and 458, urge carrier 430 and pressure pad 450 in opposite directions. The movement is limited by the interference of shoulder 462 with shoulder 443. The rate of spring 467 is selected in accordance with the desired maximum of pressure within the coolant system. In response to excessive pressure, seal 470 is lifted from pressure valve seat 55 of filler neck 50, compressing spring 467 and allowing escape of fluid through overflow passage 65.

Post 448 of carrier 430 is passed upwardly through opening 415 in cover 404 and upset as previously described to form enlarged head 468. Ample radial clearance is allowed between post 448 and opening 415 and ample longitudinal clearance is allowed between surface 437 and enlarged head 469 to affect a swivel union between attachment member 402 and sealing and valving assembly 403. To further this end, cylindrical projection 412 is loosely received within annular recess 444. As in the previous embodiments, therefore, attachment member 402 is freely rotatable relative sealing and valving assembly 403 which is limited to longitudinal movement.

Figure 16:
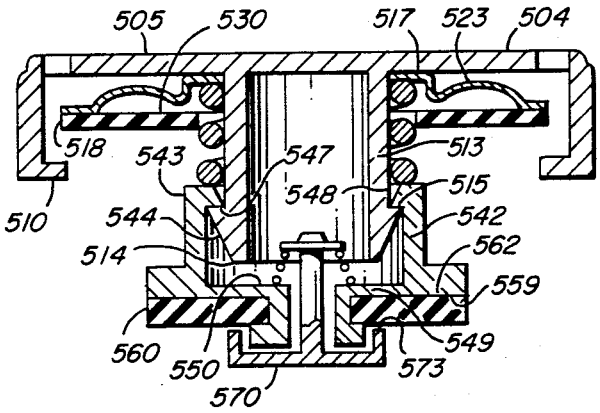
FIG. 16 is a vertical sectional view taken along the lines 16—16 of FIG. 15.
Figure 17:
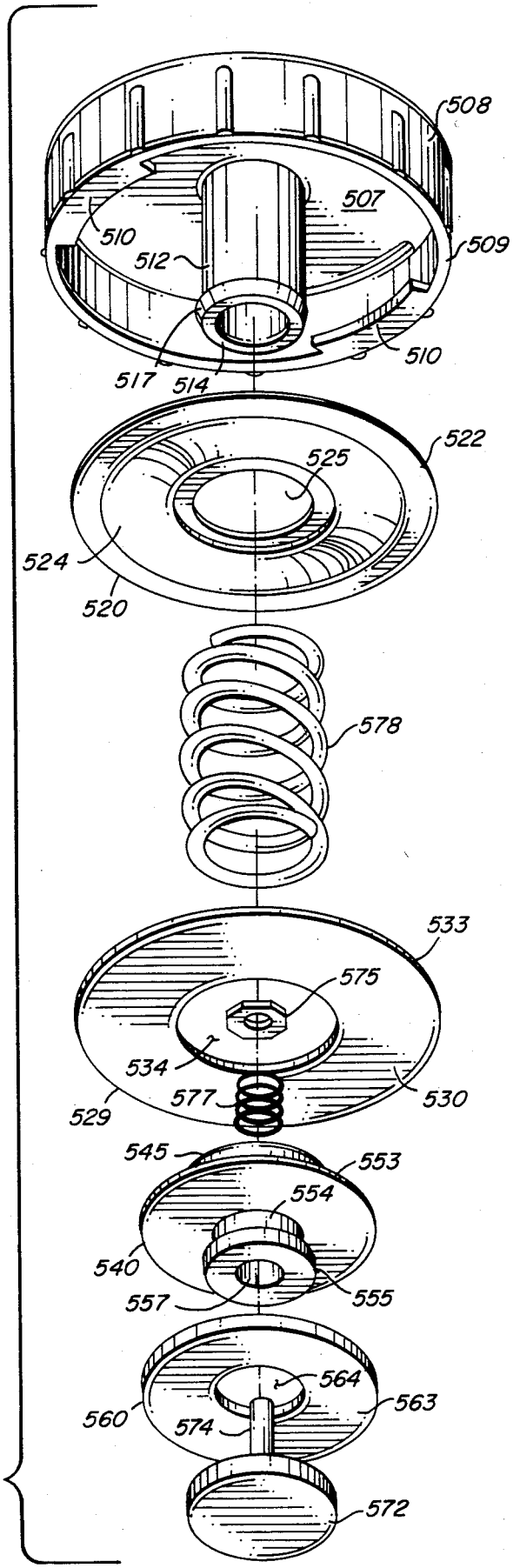
FIG. 17 is an exploded perspective view of the device of FIG. 15.

There will now be described a further embodiment of the instant invention, generally designated by the reference character 500, including an attachment member and a sealing and valving assembly generally designated by the reference characters 502 and 503, respectively. With further reference to FIGS. 16 and 17, it is seen that attachment member 502 includes cover 504 having topsurface 505 and undersurface 507. Generally cylindrical peripheral skirt 508, depending from cover 504, terminates with lower free edge 509. Inwardly directed diametrically opposed tabs 510, for purposes previously set forth, project inwardly from skirt 508.

Tubular projection 512, having outer cylindrical surface 513 and terminating with lower free end 514, depends from under surface 507. Annular shoulder 515 projects radially from surface 512 proximate lower end 514 of tubular projection 512. Downwardly, inwardly directed frustoconically beveled surface 517 extends between shoulder 515 and lower free end 514. Preferably, attachment member 502 is unitarily fabricated as a molding or diecasting of a suitable plastic material.

The uppermost component of sealing and valving assembly 503 is carrier 520, preferably formed or stamped of relatively thin spring steel. Being generally disc-shaped, carrier 520 includes generally cylindrical peripheral edge 522, topsurface 523, undersurface 524 and axially aligned opening 525 sized and shaped to loosely receive outer surface 513 of tubular projection 512. As best viewed in cross-section in FIG. 16, carrier 520 is contoured such that the uppermost portion is in the form of an annular ring 527 immediately surrounding opening 525. The lowermost portion is in the form of a second annular ring 528 immediately adjacent the peripheral edge 522. Surface 523, in the area of annular ring 527 and surface 524 in the area of ring 528, are substantially parallel.

In a preferred configuration, the atmospheric seal is in the form of a gasket 529 having substantially parallel top and undersurfaces 530 and 532, respectively, cylindrical peripheral edge 533 and central opening 534. During assembly, topsurface 530 is bonded to undersurface 524 of carrier 520 in the area of second annular ring 528. Peripheral edges 522 and 533 are substantially coincident.

Pressure pad 540, a generally cup-shaped member fabricated of a suitable plastic, includes upright cylindrical section 542, having outer side wall 543, inner side wall 544 and upper free end 545. Annular shoulder 547 projects radially inward from inner side wall 544 proximate free end 545. Inverted frustoconically beveled surface 548 extends between shoulder 547 and free end 545.

End wall 549, having topsurface 550, undersurface 552 and cylindrical peripheral edge 553, extends across the lower end of upright cylindrical section 542. Cylindrical projection 554, terminating at the lower free end with outwardly directed annular ridge 555, depends from end wall 549. Opening 557 extends coaxially through projecting 554 and end wall 549.

Pressure seal 560, the flat gasket type, having topsurface 562 and undersurface 563, is assembled with pressure pad 540 by the engagement of opening 564 over ridge 555 to reside about cylindrical projection 554 with surface 562 in juxtaposition with surface 552.

Vent valve 570 includes generally cup-shaped valve member 572 terminating with upwardly directed annular seal engaging surface 573. Stem 574, coaxial with surface 573, extends upwardly through opening 557 and has engaged therewith a retainer in the form of snap clip 575. Vent spring 577, coaxial about stem 574 and extending between spring clip 575 and surface 550, holds the vent valve 570 in the normally closed position.

Pressure spring 578 is sized to encounter outer cylindrical surface 513 of tubular projection 512. In the assembled configuration, the upper end of spring 578 bears against the undersurface of annular ring 527 while the lower end bears against the upper free end 545 of pressure pad 540. The top surface 523 of the annular ring portion 527 of carrier 520 functions as a thrust bearing against the undersurface 507 of cover 504 for free rotation of spring 578 and atmospheric seal 529. 529. Opening 534 in gasket 529 is sized to freely receive spring 578. Upright cylindrical section 542 of pressure pad 540 is assembled with tubular projection 513 of attachment member 502 by snap engagement. The interference between shoulders 515 and 547 retard disassembly.

Gasket 530 seats against annular ledge 57 at the open upper end 53 of filler neck 50 to function as the atmospheric seal. In other respects, the immediate embodiment is structurally and functionally analogous to the previously described embodiments.

Figure 18:
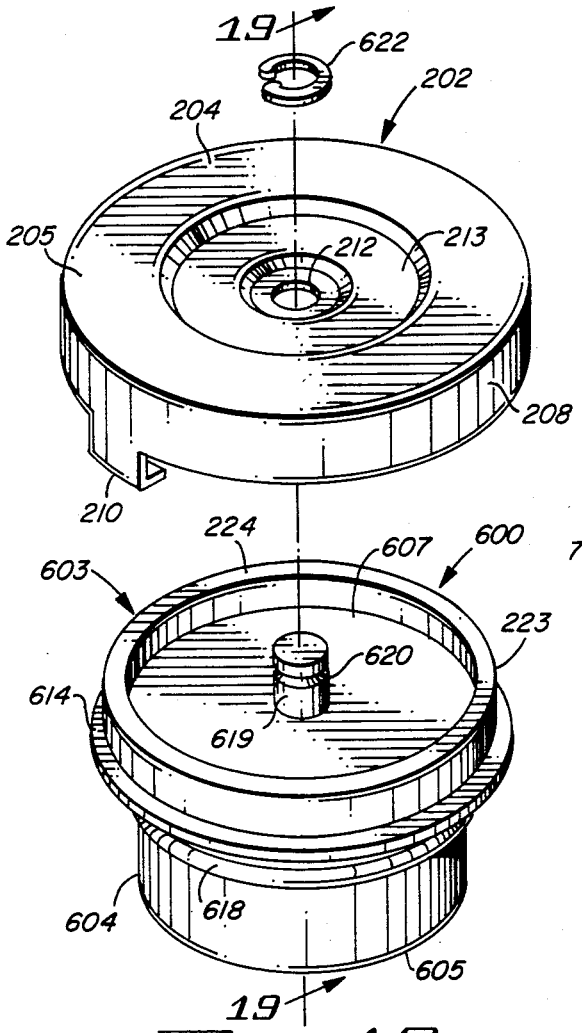
FIG. 18 is an exploded perspective view of the components of the upper portion of yet a further valving and closure apparatus incorporating the teachings of the instant invention.

FIG. 18 illustrates an embodiment, generally designated by the reference character 600, embodying the teachings of the instant invention and especially created to provide atmospheric dual seals which engage the inner cylindrical surface 68 and the seat formed by the annular ledge 57 of the typical filler neck 50. For purposes of illustration, the sealing and valving assembly, generally designated by the reference character 603, will be considered in connection with previously described attachment member 202. As will be appreciated by those skilled in the art, the immediate sealing and valving assembly 603 may be alternately coupled with other attachment members set forth herein or known in the art.

Figure 19:
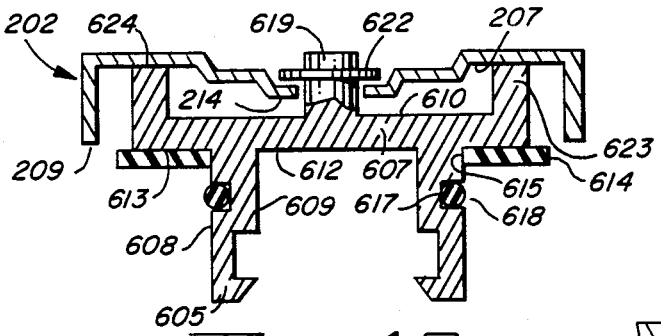
FIG. 19 is a vertical sectional view of the assembled components of FIG. 18, a section being taken along the axis of rotation thereof.

Sealing and valving assembly 603 includes upper carrier 604, a fluid impervious generally cup-like member having upright cylindrical section 605 and upper end wall 607. As further viewed in FIG. 19, cylindrical side wall 605 includes outer cylindrical surface 608 and inner cylindrical surface 609. Upper end wall 607 includes topsurface 610 and undersurface 612.

Upper end wall 607, having a substantially greater diameter than cylindrical side wall 605, extends beyond outer cylindrical surface 608 to form annular shoulder 613 on the undersurface thereof. Annular gasket-type seal 614 encircles outer cylindrical surface 608 and bears against annular ledge 613. As will be appreciated by those skilled in the art, inside diameter 615 is sized to frictionally receive surface 608 to affect a semipermanent union. Annular groove 617, formed in surface 608, carries seal 618, preferably a conventional O-ring, in a manner and for purposes as previously described.

A pintle in the form of cylindrical post 619, extending upwardly from topsurface 610 of upper end 607 along the axis of rotation of upper carrier 604, is sized to project through opening 212. Annular groove 620, formed in cylindrical post 619 at a location above topsurface 205 of cover 204, receives external snap ring 620 in accordance with conventional practice, to affect a detachable union between sealing and valving assembly 603 and attachment member 202. It is noted that opening 212 is of somewhat greater diameter than post 619 such that sealing and valving assembly 603 is freely movable relative attachment member 220. Annular projective 623, extending upwardly from upper end wall 607, terminates with bearing surface 624 which is bearable against the undersurface 207 of cover 204.

In the embodiment immediately chosen for purposes of illustration, the lower portion of upper carrier 604 is especially configured to cooperate with a lower carrier including pressure seal 470 and vent valve 480 as specifically illustrated in FIG. 13. The upper end of a pressure spring, such as pressure spring 467, bears against undersurface 612 of upper end wall 607.

When the immediate embodiment of the instant invention is secured to the filler neck, seal 618 defines a first atmospheric seal which sealingly engages the inner side wall of the tubular body of the filler neck. The sealing engagement remains intact as the apparatus is moved between the vent and the locked positions. Seal 614, functioning as a second atmospheric seal, sealingly engages the free end of the filler neck when the apparatus is in the locked or working position. Seal 614, in combination with annular projection 623, further provides a function generally analogous to the prior art spring diaphragm. As a result of the abutment of seal 614 against the end of the filler neck and the engagement of tabs 210 with the connection receiving means of the filler neck, upward pressure is exerted by annular projection 623 against cover 204 to retard relative rotation. Annular projection 623 further functions as stabilizing means to maintain the attachment member and the sealing and valving assembly in axial alignment as the assembly is engaged and disengaged with the filler neck.

Figure 20:
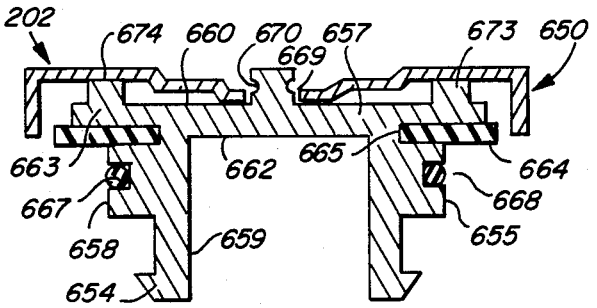
FIG. 20 is an illustration generally corresponding to the illustration of FIG. 19 and illustrating an alternately preferred embodiment thereof.

Illustrated in FIG. 20 is another embodiment of the instant invention generally designated by the reference character 650 and featuring first and second atmospheric seals. Illustrated in connection with the previously utilized representative attachment member 202, the immediate embodiment includes upper carrier 654 having upright cylindrical side wall 655 and upper end wall 657. Upright cylindrical side wall 655 is defined by outer cylindrical surface 658 and inner cylindrical surface 659. Upper end wall 657 lies between topsurface 660 and under surface 662.

Upper end wall 657, being of greater diameter than upright cylindrical side wall 655, forms, on the undersurface thereof, annular shoulder 663 external of outer cylindrical surface 658. Annular gasket 664, the second atmospheric seal in accordance with the immediate embodiment, resides against annular ledge 663. An inner portion of annular gasket 664 resides within annular groove 665 formed in cylindrical side wall 655 to maintain the assembled relationship. Annular groove 667, formed into cylindrical side wall 665 from outer cylindrical surface 658, carries the first atmospheric seal as previously described.

Cylindrical post 670, projecting upwardly from upper end wall 657 and carrying annular groove 670, projects through opening 212 in attachment member 202 to receive a snap ring to affect the union between the cover member and the sealing and valve assembly as previously described. Annular projection 673, terminating at the free end with bearing surface 674, also projects upwardly from upper end 660.

Carrier 654 is illustrated in a configuration to cooperate with a lower assembly as previously described in connection with FIG. 16. The pressure spring may reside either internally or externally of cylindrical side wall 655. For structural and functional details not recited, reference is made to the previously described embodiment illustrated in FIGS. 18 and 19. Concerning the embodiments of FIG. 18 and 19 and of FIG. 20, it will be readily apparent to those skilled in the art that the teachings of carriers 604 and 654 may be adapted to other embodiments of the invention herein illustrated. It will also be appreciated that the sealing and valving assembly and the means of attachment may be utilized in connection with attachment members of various design and fabricated of either metallic or plastic material.

Figure 21:
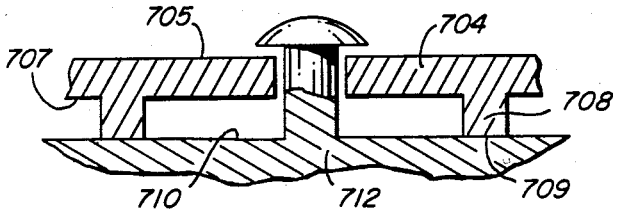
FIG. 21 is a vertical section view of a fragmentary portion of a valving and closure apparatus of the instant invention especially illustrating alternately preferred stabilizing means, the section being taken along the longitudinal axis of rotation.

Turning now to FIG. 21, there is seen alternate stabilizing means especially adapted for use in connection with a molded attachment member having cover 704 with topsurface 705 and undersurface 707. Annular projection 708 terminates with bearing surface 709 which bears against topsurface 710 of upper carrier 712. It will be appreciated by those skilled in the art that an analogous annular projection may be formed in a cover of stamped sheet metal.

Figure 22:
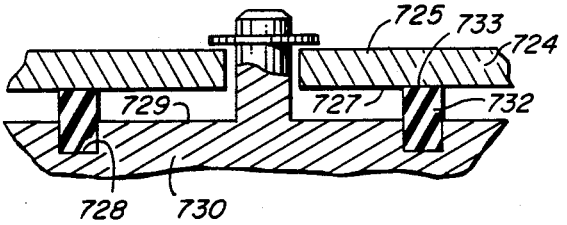
FIG. 22 is an illustration generally corresponding to that of FIG. 21 and showing yet another alternate stabilizing means.

Seen in FIG. 22 is an attachment member having cover 724 with topsurface 725 and undersurface 727. Annular groove 728 is formed into the topsurface 729 of upper carrier 730. Cylindrical insert 732 resides within groove 728 and presents bearing surface 733 to the under side 727 of cover 724. Cylindrical insert 732 may be fabricated of variously selected materials to achieve the desired stabilizing results. It is also contemplated that insert 732 may be fabricated of a conventional seal material, such as neopreme, to provide a third atmospheric seal. Selected of a resiliently compressible material, insert 732 may also function to retard rotation of the attachment member when in the locked position with the filler neck.

Figure 23:
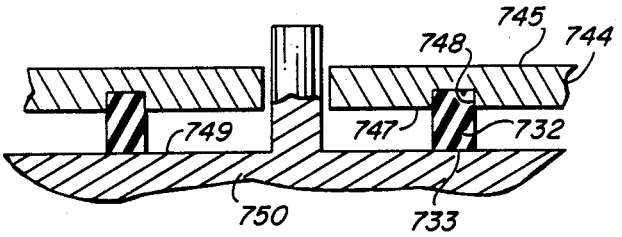
FIG. 23 is another illustration generally corresponding to the illustration of FIG. 21 and showing yet a still further stabilizing means in accordance with the instant invention.

A modification of the embodiment seen in FIG. 22 is illustrated in FIG. 23. Shown is an attachment member having cover portion 744 with topsurface 745 and undersurface 747. Cylindrical insert 732 is carried in groove 748 formed in the undersurface 747 of cover 745. Surface 733 of cylindrical insert 732 bears against the topsurface 749 of upper carrier 750. In other aspects, the immediate embodiment is analogous to the embodiment described in detail in connection with FIG. 22.

Figure 24:
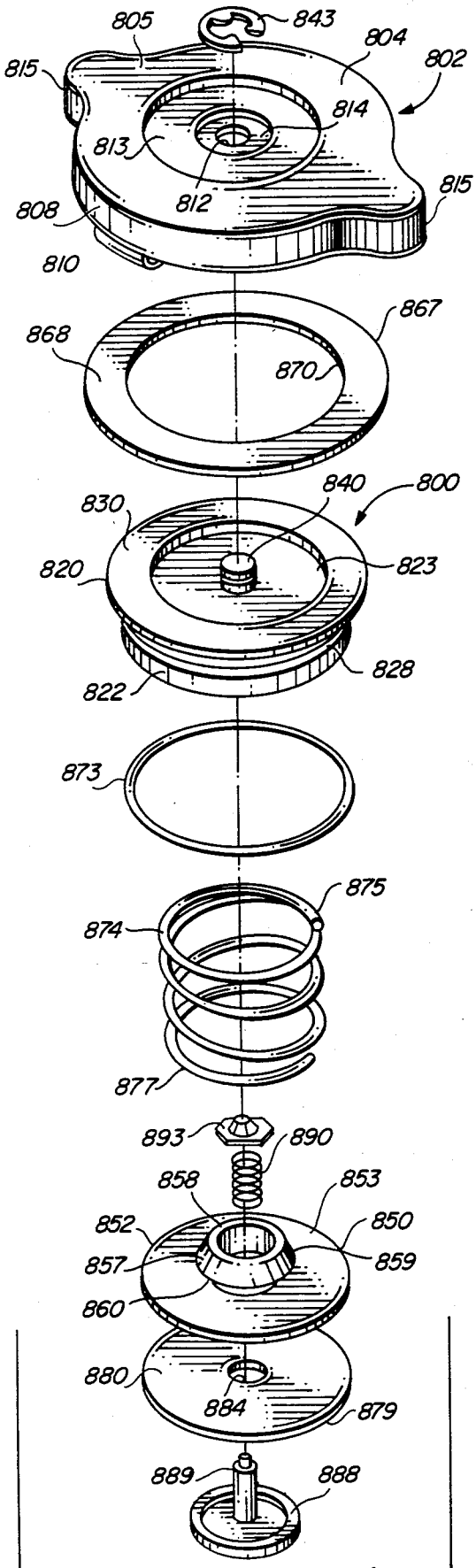
FIG. 24 is an exploded perspective view of the components of still another valving enclosure apparatus constructed in accordance with the teachings of the instant invention, the view being generally from "birds-eye" perspective.
Figure 25:
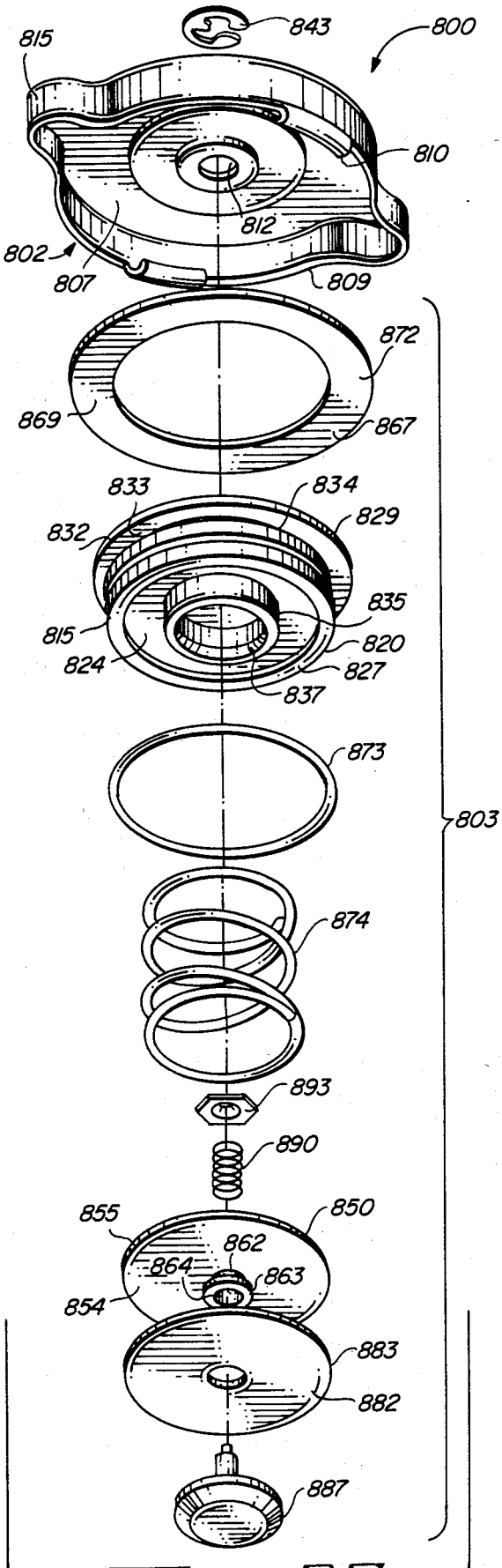
FIG. 25 is a "worms-eye" perspective view generally corresponding to the illustration of FIG. 24.

Attention is now directed to FIGS. 24 and 25 which illustrate yet another embodiment of the instant invention, generally designated by the reference character 800, including an attachment member and a sealing and valving assembly, generally designated by the reference characters 802 and 803, respectively. Closure and valving apparatus 800, in common with the previously described embodiments of the instant invention, is especially configured to function in combination with the previously described exemplary filler neck 50.

Attachment member 802 includes substantially flatter cover portion 804 having top and bottom surfaces 805 and 807, respectively. Generally cylindrical peripheral skirt 808, terminating with lower edge 809 depends from cover 804. A pair of diametrically opposed tabs 810 project inwardly from skirt 808.

Opening 812, being substantially axially aligned, projects through cover 804. A recess 813 is formed downwardly into cover 804. A second recess 814 is further formed in recess 813. Recesses 813 and 814 are generally cylindrical and concentric with opening 812. A pair of diametrically opposed ears 815 project from cover portion 804. Skirt 808 is continuous about ears 815.

Attachment member 802 is detachably securable to filler neck 50 as previously described. Ears 815 provide grip means for the hand of the operator.

Sealing and valving assembly 803 includes upper carrier 820 which, in general analogy to the previously described corresponding components, is fabricated of a fluid impervious material. While preferrably molded of a plastic material, the carrier may be machined or cast of metal. Being generally cylindrical in shape, carrier 820 includes side wall 822, sized to be received within filler neck 50 and top and undersurfaces 823 and 824, respectively. Peripheral skirt 825, continuous with side wall 822 projects below undersurface 824 terminating with lower edge 827. Annular groove 828 is formed into side wall 822.

Annular flange 829 projects outwardly from side wall 822. Flange 829 is defined by topsurface 830 which projects above topsurface 823, outer edge 832 and undersurface 833. A second annular groove 834 is formed into side wall 822 immediately under flange 829.

Tubular projection 835, terminating with free end 837, depends from undersurface 824. With momentary reference to FIG. 26, it is seen that free end 837 includes upwardly inwardly, generally frustroconical, beveled surface 838 which extends to inwardly directed annular shoulder 839.

Cylindrical post 840 projects upwardly from topsurface 823. Groove 842 formed in the termness of post 840 accommodates external snap ring 843.

Lower carrier 850, another component of sealing and valving assembly 803, includes disc-like element 852 having topsurface 853, undersurface 854 and peripheral edge 855. Surfaces 853 and 854 are generally a planar end parallel while peripheral edge 855 is generally cylindrical. Tubular projection 857 extends upwardly from surface 853 terminating with free end 858. Formed at free end 858 is downwardly outwardly, generally frustroconical, beveled surface 859 terminating at the lower edge with inwardly directed radial shoulder 860. Cylindrical element 862 terminating with annular enlargement 863 depends from disk-like element 852. Bore 864 extends through lower carrier 850.

Further included in the immediate embodiment are two seals, annular gasket 867 having topsurface 868, bottom surface 869 and generally concentric inner and outer edges 870 and 872, respectively, and O-ring 873. Further included is cylindrical helical compression spring 874 having upper end 875 and lower end 877. In accordance with conventional practice the terminal coil at each end departs from the helical winding to reside in a plane substantially perpendicular to the longitudinal axis. Also provided is gasket 879 having topsurface 880, under surface 882, outer peripheral edge 883 and opening 884 therethrough.

Carried by lower carrier 850, as will be presently described in greater detail, is a vent valve assembly including generally cup-shaped valve member 887 having upwardly directed annular surface 888 and upwardly extending stem 889. Also included is compressionized spring 890 and snap engageable retainer 893.

The several components described in detail in connection with FIGS. 24 and 25 are viewed as an assembly in FIG. 26. Tubular projections 835 and 857 function as connection means for telescopingly securing lower carrier 850 to upper carrier 820. Oweing to beveled surfaces 839 and 859 and a material of construction having slightly resilient characteristics, the components are assembled by snap engagement. The interference of annular shoulder 839 with radial shoulder 860, which function as abutment means, limit the movement of lower carrier 850 in a direction away from a upper carrier 820.

Spring 874, encircling tubular projections 835 and 857, functions as biasing means normally urging lower carrier 850 in a direction away from upper carrier 820. As previously noted, the action of spring 874 is opposed and limited by the abutment of annular shoulder 839 against radial shoulder 860. The upper end 875 of spring 874 bears against undersurface 824 of upper carrier 820 while the lower end 877 of spring 874 bears against upper surface 853 of lower carrier 850.

In accordance with conventional practice, pressure valve seat 55 is formed as an annular bead of convex cross section. The center of the bead can be defined as the circular line of contact between the bead and a plane laid thereagainst. In accordance with the immediate embodiment of the invention, spring 874 is a cylindrical helical coil. The center of the spring can be defined as a right cylinder passing through the vertical diameter of the spring wire. It is within the scope of the instant invention that the center of spring 874 is congruent with the center of the bead formed at valve seat 55.

Gasket 879 is held in snap engagement with lower carrier 850 by virtue of snap engagement of opening 884 over enlargement 863 to encircle cylindrical element 862 such that topsurface 880 of gasket 879 resides against undersurface 854 of disk-like element 852. Disk-like element 852 functions as a pressure pad to distribute the force of spring 874 to gasket 879. The alignment of spring 879 with valve seat 55 as described above, insures constant uniform seating of gasket 879 against valve seat 55. Further, the force of spring 874 is transmitted in a straight line through disk-like element 850, thereby insuring that disk-like member 850 will remain distortion free. It is noted that skirt 825 closely receives, in locational fit, the upper end of spring 874. Accordingly, the recess formed on the underside of carrier 820 by skirt 825 functions as alignment means for maintaining the previously described alignment between spring 874 and valve seat 55.

Functioning as union means for rotatably securing sealing and valving assembly 803 to attachment member 802 is cylindrical post 840 extending upwardly through opening 812. Post 840 is of sufficient length that groove 842 resides at a location above the upper surface of attachment member 802. Snap ring 843, functioning as a retention element for detachable securement of attachment member 802 to sealing and valving assembly 803, is received within groove 842. Recess 814 is sized to receive snap ring 843. Preferrably, recesses 813 and 814 are of sufficient depth such that the upper end of post 840 lies at or below the topsurface 805 of cover portion 804. Accordingly, the device is free of encumbering projections.

The vent valve assembly is carried by lower carrier 850. Stem 889 projects upwardly through opening 864 such that valve member 887 resides on the under side of gasket 879. The upper portion of stem 889, which resides within tubular projection 857 is encircled by spring 890 which in turn is retained by retainer 893 affixed to stem 889 by snap engagement. Being of the compression type, spring 890 normally urges annular surface 888 into sealing engagement with the undersurface 882 of gasket 879.

Annular gasket 867 is retained in assembly with upper carrier 820 by means of an inner portion adjacent inner surface 870 being engaged within annular groove 834. Upper surface 868 of annular gasket 867 resides against undersurface 833 of annular flange 829. It is noted that annular ledge 57 of filler neck 50, in general similarity to valve seat 55 is in the form of an annular bead of generally convex cross section. Outer edge 832 of annular flange 829 extends radially outward beyond the bead formed by ledge 57. Groove 828 functions as a gland for supporting O-ring 873.

Figure 26:
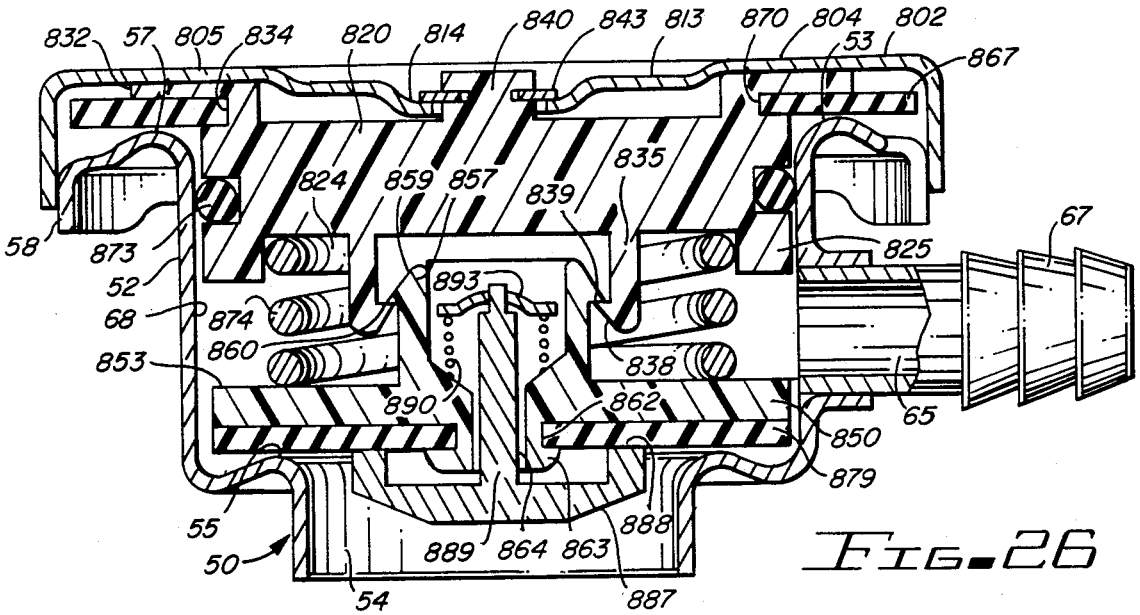
FIG. 26 is a vertical sectional view, generally taken along the longitudinal axis of rotation thereof illustrating the assembled components of the embodiment of FIG. 24 as the embodiment would appear when assembled with a conventional filler neck, the filler neck being partially broken away for purposes of illustration and the valving enclosure apparatus being illustrated in the vent position.

As illustrated in FIG. 26, the closure and valving apparatus of the instant invention is coupled with filler neck 50 by virtue of attachment member 820 being in the unlocked position. In this position, the undersurface 822 of gasket 879 is spaced above valve seat 55. The undersurface 869 of gasket 867 either lightly touches or is spaced from ledge 57. O-ring 873 is sealingly engaged with the inner cylindrical surface 68 of filler neck 50. Accordingly, pressurized coolant from within the cooling system can vent upwardly to be discharged through overflow passage 65. The coolant, however, is prevented from escaping through the open end of filler neck 50 as a result of the sealing engagement of O-ring 873 with filler neck 50. It is also noted that the lower edge 827 of skirt 825 resides at a location spaced above passage 65.

Figure 27:
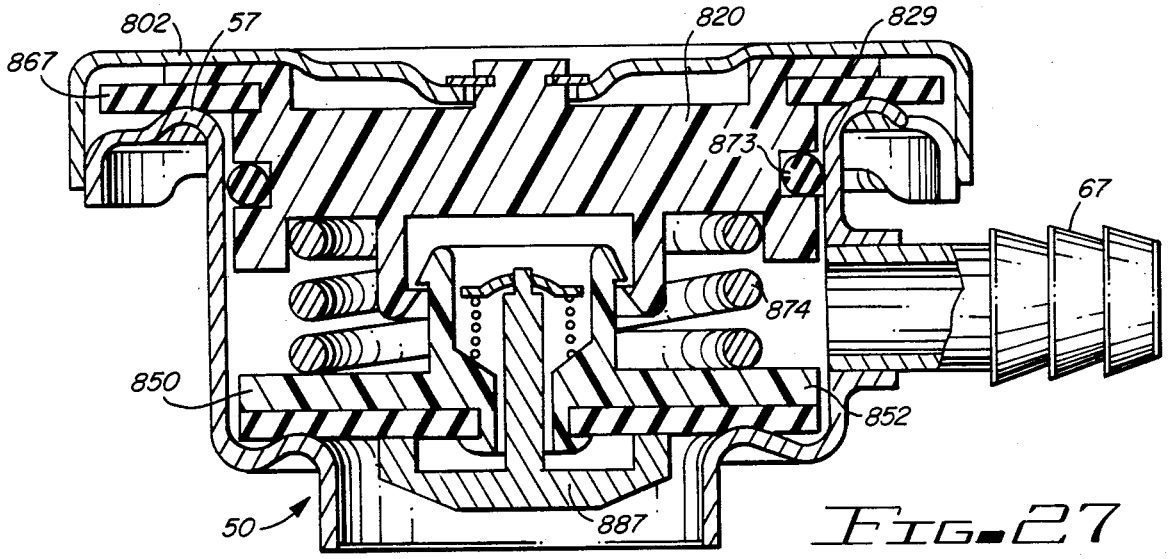
FIG. 27 is a view generally corresponding to illustration of FIG. 26 as the valving enclosure apparatus would appear when in the locked position.

Referring now to FIG. 27, the closure and valving apparatus is seen as it would appear when attachment member 802 is rotated to the locked or safe position. During rotation of attachment member 802, sealing and valving assembly 803 did not rotate but rather, moved axially downward. In response to the downward movement, gasket 879 is brough into sealing engagement with pressure valve seat 55 and gasket 867 is brought into sealing engagement with annular ledge 57. During rotation of attachment member 820 between the unlocked and locked position, upper carrier 820 moves a greater distance than lower carrier 850. In the illustration, it is noted that radial shoulder 860 is unseated from annular shoulder 839. Accordingly, spring 874 is preloaded to retain gasket 879 against seat 55 at a predetermined pressure value.

Gasket 879 functions as a pressure seal to retain pressurized liquid within the cooling system. O-ring 873 functions as an atmospheric seal to effectively close the open end of filler neck 50. In comparing FIG. 26 with FIG. 27, it is apparent that O-ring 873 functions regardless of the position of the closure and valving assembly. In the locked position, gasket 867 functions as a further atmospheric seal to close the open end of filler neck 50. In the closed position as illustrated, gasket 867 and annular flange 829 are in compression between ledge 57 and the undersurface 807 of attachment member 802. The force exherted upon attachment member 802 functions to frictionally restrain rotation of attachment member 802 in response to engine vibration. Flange 829, the topsurface 830 thereof bearing against the under surface 807 of cover portion 804, functions as stabilizing means for axial alignment between the attachment member 802 and the sealing and valving assembly 803 during attachment of the device of the instant invention with the filler neck.

Figure 28:
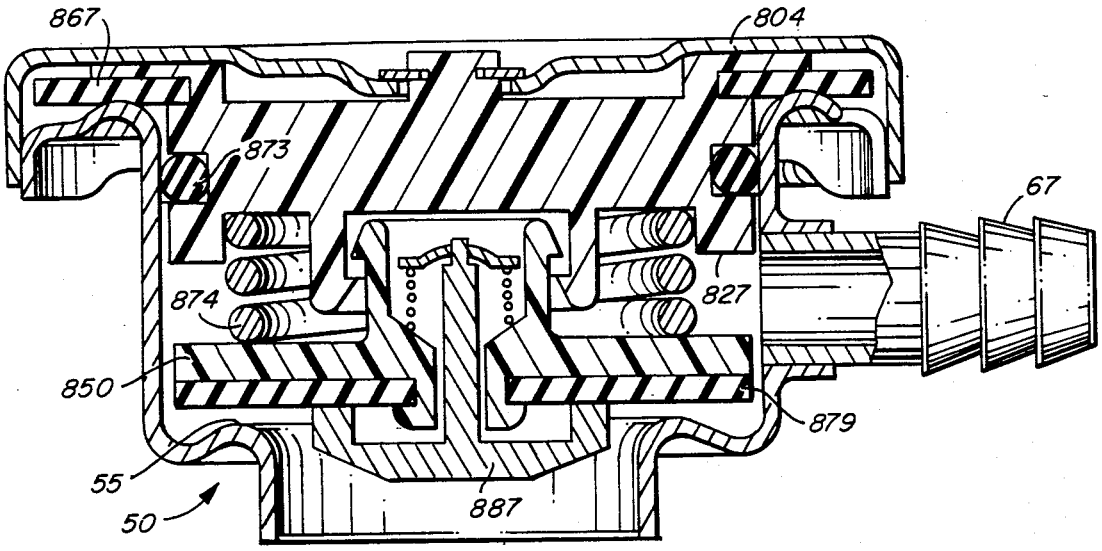
FIG. 28 is another view generally corresponding to the illustration of FIG. 26 showing the device of the instant invention as it would appear during relief of excessive pressure from within the coolant system.

In response to a buildup of pressure within the cooling system which excedes the predetermined value of spring 874, lower carrier 850 is urged upwardly as seen in FIG. 28. Gasket 879 is separated from seat 55 allowing flow of fluid through the pressure seal around the pressure pad or disk-like element 852 to escape through vent opening 65. It is noted that in the locked position, lower edge 827 of skirt 825 resides at a location near the uppermost portion of vent passage 65 so as to promote uninhibited liquid flow.

As will be appreciated by those skilled in the art, the closure and valving apparatus of the instant invention will return to the configuration illustrated in FIG. 27 when the pressure subsides to a level below the value of spring 874. As the system continues to cool, a partial vacuum will be created opening the vent valve assembly. During opening, valve member 887 is drawn downwardly, compressing a spring 890 and unseating annular surface 888 from gasket 879. Due to the clearance between tubular projections 835 and 857, fluid can be drawn through passage 65, between the tubular projections, stem 889 and opening 624, to pass between gasket 879 and surface 888 to enter the cooling system. As the vacuum is relieved, the vent valve assembly will again close in response to the action of spring 890.

Various modifications and changes to the embodiments herein chosen for purposes of illustration will readily occur to those skilled in the art. For example, the several sealing and valving assemblies are alternately usable with variously configured attachment members of either molded plastic or resinous material or of stamped metal design. Similarily, the various stabilizing means are readily adaptable for incorporation into alternately selected embodiments. Further, the teaching of the employment of plural atmospheric seals is intended to embrace other specific embodiments of the invention. Also, the illustrations of specific vent valve designs is set forth as exemplary, it being understood that a selected embodiment may include any selected vent valve of known or contrived description.

The foregoing is given by way of example only. Other modifications and variations may be made by those skilled in the art without departing from the scope of the invention as defined by the following claims.

Having fully described and disclosed the present invention and preferred embodiments thereof in such clear and concise terms as to enable those skilled in the art to understand and practice same, the invention claimed is:

1. In a closure and valving apparatus for use in connection with the filler neck of a pressurized liquid cooling system, which filler neck includes a tubular body having a generally cylindrical inner surface, an upper open end having an annular gasket seat, engagement receiving means proximate said open end and having a lock position and an unlock position, and which closure and valving apparatus includes an attachment member having engagement means connectable with the engagement receiving means of said filler neck, said attachment member being rotatable between said lock position and said unlock position, an upper carrier having an upright cylindrical sidewall and an upper end wall, union means for rotatably securing said upper carrier to said attachment member, and an atmospheric seal, comprising a first atmospheric seal, carried by the cylindrical sidewall of said upper carrier and sealingly engagable with the inner surface of said filler neck, improvements therein for sealingly closing the open end of said filler neck, said improvements comprising:

atmospheric seal means, comprising a second atmospheric seal, for sealing engagement with the annular gasket seat at the open end of said filler neck.

2. The improvements of claim 1, wherein said atmospheric seal means is carried by said carrier.

3. The improvements of claim 2, wherein said atmospheric seal means includes:

(a) an annular shoulder projecting radially outward from the cylindrical sidewall of said upper carrier; and (b) an annular seal, comprising a second atmospheric seal, carried against said annular shoulder for sealing engagement with said annular gasket seat.

4. The improvements of claim 3, wherein said annular seal includes an inside diameter which is frictionally received over said cylindrical sidewall.

5. The improvements of claim 3, further including an annular groove formed in the cylindrical sidewall of said upper carrier for receiving a portion of said annular seal adjacent the inside diameter thereof.

6. The improvements of claim 3, wherein said annular seal is in compression between said annular shoulder and said annular gasket seat when said attachment member is in said lock position, said compression exerting a force to retard rotation of said attachment member relative said filler neck.

7. The improvements of claim 6, further including stabilizing means for transmitting said force from said upper carrier to said attachment member.

8. The improvements of claim 7, wherein said stabilizing means includes a projection upstanding from said upper carrier and having a bearing surface receivable against said attachment member.

9. The improvements of claim 7, wherein said stabilizing means includes a projection depending from said attachment member and having a bearing surface receivable against said upper carrier.

10. The improvements of claim 7, wherein said stabilizing means includes:

(a) a groove forward into the upper end wall of said upper carrier; and (b) an insert carried in said groove and projecting therefrom to a bearing surface receivable against said attachment member.

11. The improvements of claim 7, wherein said stabilizing means includes:

(a) groove formed into said attachment member; and (b) an insert carried in said groove and projecting therefrom to a bearing surface receivable against said upper carrier.

12. The improvements of claim 7, wherein said stabilizing means is in the form of an annular seal member of resiliently compressible material.

13. The improvements of claim 1, wherein said union means includes an opening through said attachment member.

14. The improvements of claim 13, further including a third atmospheric seal encircling said union means and sealing said carrier to said attachment member.

15. The improvements of claim 14, wherein said third atmospheric seal includes:

(a) an annular groove formed in the upper end wall of said upper carrier; and (b) an annular insert carried in said groove and sealingly engagable with said attachment member.

16. The improvements of claim 14, wherein said third atmospheric seal includes:

(a) an annular groove formed in said attachment member;

(b) an annular insert in said groove and sealing engagable with said upper carrier.

17. The improvements of claim 13, wherein said union means further includes:

(a) a post upstanding from said upper carrier and extending through the opening through said attachment member, and (b) retention means for retaining said post within said opening.

18. The improvements of claim 17, wherein said retention means includes:

(a) a free end of said post supratending said attachment member; and (b) a retention element carried proximate the free end of said post and having a size greater than the size of the opening in said attachment member.

19. The improvements of claim 18, wherein said retention element comprises an enlargement integrally formed with said post.

20. The improvements of claim 18, wherein said retention element is detachably securable to said post.

21. The improvements of claim 13, wherein said union means further includes a fastening element extending through said opening and engaged with said upper carrier.

22. The improvements of claim 17, wherein said union means detachably secure said upper carrier to said attachment member.

23. The improvements of claim 22, wherein said retention means is compressible for passage through said opening.

24. The improvements of claim 17, wherein said post is loosely received through said opening.

25. The improvements of claim 1, wherein said attachment member is molded of a resinous material.

26. The improvements of claim 1, wherein said attachment member is formed of a metallic material.

27. An improved closure and valving apparatus for use in connection with the filler neck of a pressurized liquid cooling system, which filler neck includes a tubular body having a generally cylindrical inner surface, an upper open end having an annular gasket seat, engagement receiving means proximate said open end and having a lock position and an unlock position, an inwardly directed annular valve seat spaced from the open end, and a vent opening intermediate said open end and said valve seat, and for providing an ameliorated sealing engagement between said closure and valving apparatus and said filler neck, said improved closure and valving apparatus comprising:

(a) an attachment member including engagement means connectable with the engagement receiving means of said filler neck and rotatable between said lock position and said unlock position;

(b) a sealing and valving assembly including i. atmospheric seal means for closing said filler neck at a location above said vent opening, ii. pressure seal means cooperating with said annular valve seat for controlled release of said pressurized liquid from said cooling system, and iii. vent valve means for controlled flow of fluid into said cooling system; and (c) swivel means coupling said sealing and valving assembly to said attachment member.

28. The improved closure and valving apparatus of claim 25, wherein said atmospheric seal means sealingly engages the inner cylindical surface of said tubular body intermediate said open end and said vent opening.

29. The improved closure and valving apparatus of claim 28, further including additional atmospheric seal means sealingly engagable with said annular gasket seat.

30. The improved closure and valving apparatus of claim 30, wherein said atmospheric seal means is sealingly engagable with said annular gasket seat.

31. The improved closure and valving apparatus of claim 30, further including additional atmospheric seal means engagable with the inner cylindrical surface of said tubular body intemediate said open end and said vent opening.

32. The improved closure and valving apparatus of claim 27, wherein:

(a) said sealing and valving apparatus further includes an upper carrier for carrying said astmospheric seal; and (b) said swivel means couples said upper carrier to said attachment member.

33. The improved closure and valving apparatus of claim 32, wherein said swivel means includes:

(a) a pintle upstanding from said upper carrier generally coaxial with the inner cylindrical surface of said tubular body, (b) pintle receiving means carried by said attachment member; and (c) retention means for retaining said pintle within said pintle receiving means.

34. The improved closure and valving apparatus of claim 33, wherein:

(a) said pintle receiving means extends through said attachment member;

(b) said pintle projects through said pintle receiving means and includes a terminus supratending said attachment member; and (c) said retention means is carried by the terminus of said pintle.

35. The improved closure and valving apparatus of claim 34, wherein said retention means is in the form of an enlargement having a size sufficient to prohibit passage through said pintle receiving means.

36. The improved closure and valving apparatus of claim 35, wherein said pintle is fabricated of a thermoplastic material and said enlargement is integrally molded.

37. The improved closure and valving apparatus of claim 35, wherein said pintle is assemblable with said pintle receiving means by snap engagement.

38. The improved closure and valving apparatus of claim 35, wherein said pintle is detachably secured within said pintle receiving means.

39. The improved closure and valving apparatus of claim 38, wherein said enlargement is compressible for passage through said pintle receiving means.

40. The improved closure and valving apparatus of claim 38, wherein said enlargement is detachably engagable with said pintle.

41. The improved closure and valving apparatus of claim 32, wherein said swivel means includes:

(a) an opening through said attachment member substantially coaxial with the inner cylindrical surface of said filler neck; and (b) a fastening element extending through said opening and engaged within said upper carrier.

42. The improved closure and valving apparatus of claim 32, wherein said upper carrier is longitudinally and radially movable relative said attachment member.

43. The improved closure and valving apparatus of claim 42, further including stabilizing means for holding said upper carrier in axial alignment with attachment member when said upper carrier and said attachment member are urged together.

44. The improved closure and valving apparatus of claim 32, wherein said attachment member is fabricated of a resinous material.

45. The improved closure and valving apparatus of claim 32, wherein said attachment member is fabricated of metal.

46. An improved closure and valving apparatus for use in connection with the filler neck of a pressurized liquid cooling system, which filler neck includes a tubular body having a generally cylindrical inner surface, an open end having an annular gasket seat, engagement receiving means proximate said open end and having a lock position and an unlock position, an inwardly directed annular valve seat spaced from the open end, and a vent opening intermediate said open end and said valve seat, and for providing ameliorated seating engagement between said closure and valving apparatus and said filler neck, said improved closure and valving apparatus comprising:

a. an attachment member including engagement means connectable with the engagement receiving means of said filler neck and rotatable between said lock position and said unlock position;

b. a sealing and valving assembly including i. an upper carrier, ii. a lower carrier, iii. connection means telescopingly affixing said lower carrier to said upper carrier, iv. atmospheric seal means carried by said upper carrier for closing said filler neck at a location above said vent opening, v. pressure seal means carried by said lower carrier and sealingly engageable with said annular valve seat, vi. vent valve means carried by said lower carrier for controlled flow of fluid into said cooling system, and vii. biasing means interacting between said upper carrier and said lower carrier for movably urging said pressure seal means into sealing engagement with said annular valve seat when said attachment member is in said lock position; and c. union means rotatably securing said upper carrier to said attachment member.

47. The improved closure and valving apparatus of claim 46, wherein said biasing means exerts a force directed in substantial uniform opposed alignment with said annular valve seat.

48. The improved closure and valving apparatus of claim 47, wherein said biasing means includes a helical spring having an upper end bearing against said upper carrier and a lower end bearing against said lower carrier, said lower end defining a circle substantially congruent with the annular valve seat of said filler neck.

49. The improved closure and valving apparatus of claim 48, further including alignment means for maintaining the lower end of said spring in substantial congruent alignment with said annular valve seat.

50. The improved closure and valving apparatus of claim 49, wherein said alignment means includes an annular recess with said upper carrier for closely receiving the upper end of said spring.

51. The improved closure and valving apparatus of claim 46, wherein said upper carrier includes:

a. an upper surface opposing said attachment member;

b. a cylindrical side wall receivable within said filler neck and terminating with a lower edge residing at a location for unobstructed passage of fluid through said vent opening when said attachment member is in said lock position.

52. The improved closure and valving apparatus of claim 52, wherein:

a. said upper carrier includes i. a lower surface spaced from said upper surface ii. a peripheral skirt depending from said lower surface and terminating with the lower edge of said cylindrical sidewall;

b. said connection means includes i. a first tubular member depending from the lower surface of said upper carrier coaxial with said skirt, ii. a second tubular member extending upwardly from said lower carrier coaxial with said first tubular member one of said tubular members being telescopingly received within the other of said tubular members, and iii. abutment means interacting between said tubular members for limiting the movement of said lower carrier in a direction away from said upper carrier; and c. said biasing means includes a helical spring encircling said tubular members and having i. an upper end received within the skirt and bearing against the lower surface of said upper carrier, and ii. a lower end bearing against said lower carrier.

53. The improved closure and valving apparatus of claim 52 wherein said atmospheric seal means sealingly engages the annular gasket seat of said filler neck when said attachment member is in said lock position.

54. The improved closure and valving apparatus of claim 53, wherein said atmospheric seal means includes;

a. an annular flange extending radially outward from said cylindrical sidewall and having an undersurface; and b. an annular gasket carried against the undersurface of said annular flange.

55. The improved closure and valving apparatus of claim 54, wherein said annular flange further includes an upper surface for contacting said attachment member.

56. The improved closure and valving apparatus of claim 55, wherein said annular flange and said annular gasket are in compression between said attachment member and said annular gasket seat when said attachment member is in said lock position.

57. The improved closure and valving apparatus of claim 53, wherein said atmospheric seal further sealingly engages the cylindrical inner surface of said filler neck when said attachment member is in said lock position and in said unlock position.

58. The improved closure and valving apparatus of claim 46, wherein said union means detachably secures said upper carrier to said attachment member.

59. The improved closure and valving apparatus of claim 58, wherein said union means includes:

a. an opening through said attachment member;

b. a pintle extending upwardly from said upper carrier through said opening and having a terminus supratending said attachment member; and c. a retention element detachably securable to said terminus.

* * * * *